US007701416B2

(12) United States Patent
Kim et al.

(10) Patent No.: US 7,701,416 B2
(45) **Date of Patent: *Apr. 20, 2010**

(54) PLASMA DISPLAY APPARATUS AND DRIVING METHOD THEREOF

(75) Inventors: Won Jae Kim, Masan-si (KR); Kyoung Jin Jung, Gumi-si (KR); Sung Im Lee, Gumi-si (KR)

(73) Assignee: LG Electronics Inc., Seoul (KR)

( * ) Notice: Subject to any disclaimer, the term of this patent is extended or adjusted under 35 U.S.C. 154(b) by 1141 days.

This patent is subject to a terminal disclaimer.

(21) Appl. No.: 11/326,377

(22) Filed: Jan. 6, 2006

(65) Prior Publication Data

US 2006/0273992 A1 Dec. 7, 2006

(30) Foreign Application Priority Data

Jun. 7, 2005 (KR) ..... 10-2005-0048590

(51) Int. Cl.
*G09G 3/28* (2006.01)

(52) U.S. Cl. ..... 345/68; 345/60

(58) Field of Classification Search ..... 345/37, 345/60–68; 315/169.4
See application file for complete search history.

(56) References Cited

U.S. PATENT DOCUMENTS 6,816,133 B2 * 11/2004 Tsai ..... 345/60
7,145,582 B2 * 12/2006 Shindo et al. ..... 345/691
7,161,607 B2 * 1/2007 Choi ..... 345/690
7,180,482 B2 * 2/2007 Homma ..... 345/66
7,564,429 B2 * 7/2009 Yang et al. ..... 345/67
2004/0108975 A1 * 6/2004 Araki ..... 345/63
2005/0088375 A1 * 4/2005 Son ..... 345/60
2005/0237276 A1 10/2005 Tsuchida et al. ..... 345/63

(Continued)

FOREIGN PATENT DOCUMENTS

CN 1504982 A 6/2004

(Continued)

OTHER PUBLICATIONS

Chinese Office Action dated Jun. 6, 2008.

(Continued)

*Primary Examiner*—Richard Hjerpe
*Assistant Examiner*—Mansour M Said
(74) *Attorney, Agent, or Firm*—KED & Associates, LLP

(57) ABSTRACT

The present invention relates to a plasma display apparatus, and more particularly, to a plasma display apparatus and driving method thereof, wherein a sustain waveform can be improved. According to the present invention, the plasma display apparatus includes a plasma display panel comprising a plurality of sustain electrode pairs wherein each of the sustain electrode pairs has a scan electrode and a sustain electrode, and a sustain waveform controller for controlling a rising time or a falling time of sustain waveforms supplied to at least one of the sustain electrode pairs according to a temperature of the plasma display panel. The sustain waveform controller controls a time corresponding to a time point at which a sustain discharge is generated, of the rising time and the falling time. The present invention improves a plasma display apparatus and driving method thereof. Accordingly, there is an effect in that erroneous discharge depending on a temperature of a plasma display panel can be prevented.

23 Claims, 21 Drawing Sheets

U.S. PATENT DOCUMENTS

2005/0259044 A1 11/2005 Choi et al. ..... 345/63

FOREIGN PATENT DOCUMENTS

EP 1 274 064 A2 1/2003
EP 1 315 140 A2 5/2003
EP 1 398 756 A2 3/2004
EP 1 424 679 A2 6/2004
EP 1 530 192 A2 5/2005
KR 10-2004-0110687 A 12/2004

OTHER PUBLICATIONS

Korean Office Action dated Sep. 15, 2006.

* cited by examiner

PLASMA DISPLAY APPARATUS AND DRIVING METHOD THEREOF

BACKGROUND OF THE INVENTION

Cross-References to Related Applications

This Nonprovisional application claims priority under 35 U.S.C. § 119(a) on Patent Application No. 10-2005-0048590 filed in Korea on Jun. 7, 2005 the entire contents of which are hereby incorporated by reference.

FIELD OF THE INVENTION

The present invention relates to a plasma display apparatus, and more particularly, to a plasma display apparatus and driving method thereof, wherein a sustain waveform can be improved.

BACKGROUND OF THE RELATED ART

Generally, in a plasma display panel, a barrier rib formed between a front panel and a rear panel forms one unit cell. Each cell is filled with a main discharge gas such as neon (Ne), helium (He) or a mixed gas (Ne+He) of Ne and He, and an inert gas containing a small amount of xenon. If the inert gas is discharged with a high frequency voltage, it generates vacuum ultraviolet rays. Phosphors formed between the barrier ribs are light-emitted to display an image. Such a plasma display panel can be made thin and slim, and has thus been in the spotlight as the next-generation display devices.

FIG. 1 shows the construction of a common plasma display panel.

As shown in FIG. 1, the plasma display panel includes a front substrate 100 and a rear substrate 110. The front substrate 100 has a plurality of sustain electrode pairs arranged on a front substrate 101 serving as the display surface on which the images are displayed. Each of the sustain electrode pairs has scan electrodes 102 and sustain electrodes 103. The rear substrate 110 has a plurality of address electrodes 113 arranged on a rear substrate 111 serving as the rear surface. The address electrodes 113 cross the plurality of sustain electrode pairs. At this time, the front panel 100 and the rear panel 110 are parallel to each other with a predetermined distance therebetween.

The front panel 100 includes the scan electrodes 102 and the sustain electrodes 103, which discharge the other in a mutual manner and maintain emission of cells, in one discharge cell. That is, each of the scan electrode 102 and the sustain electrode 103 has a transparent electrode "a" made of a transparent ITO material, and a bus electrode "b" made of a metal material. The scan electrodes 102 and the sustain electrodes 103 are covered with one or more upper dielectric layers 104 for limiting a discharge current and providing insulation among the electrode pairs. A protection layer 105 on which magnesium oxide (MgO) is deposited in order to facilitate a discharge condition is formed on the entire surface of the upper dielectric layer 104.

Stripe type (or well type) barrier ribs 112 for forming a plurality of discharge spaces (i.e., discharge cells) are arranged parallel to each other on the rear panel 110. Further, a number of address electrodes 113 that perform an address discharge to generate vacuum ultraviolet rays is disposed parallel to the barrier ribs 112. R, G and B phosphors 114 that emit visible ray for image display upon address discharge are coated on a top surface of the rear panel 110. A lower dielectric layer 115 for protecting the address electrodes 113 is formed between the address electrodes 113 and the phosphors 114.

In the plasma display panel constructed above, a plurality of discharge cells is formed in matrix arrangement form. In these discharge cells, the scan electrodes or the sustain electrodes are formed at the interactions at which they cross the address electrodes. A method of implementing image gray levels of the plasma display apparatus constructed above will be described with reference to FIG. 2.

FIG. 2 is a view for illustrating the method of implementing image gray levels of the conventional plasma display panel.

As shown in FIG. 2, in order to represent the image gray level in the conventional plasma display panel, one frame is divided into a plurality of sub-fields having a different number of emissions. Each of the sub-fields is subdivided into a reset period RPD for initializing all cells, an address period APD for selecting discharge cells, and a sustain period SPD for implementing the gray level according to the number of discharges. For example, if it is desired to display an image with 256 gray levels, a frame period (16.67 ms) corresponding to 1/60 seconds is divided into eight sub-fields SF1 to SF8, as shown in FIG. 2. Each of the eight sub-fields SF1 to SF8 is subdivided into a reset period, an address period and a sustain period.

The reset period and the address period of each of the sub-fields are the same every sub-field. The address discharge for selecting cells to be discharged is generated by a voltage difference between the X electrodes and transparent electrodes being the Y electrodes. In this case, the Y electrodes refer to the scan electrode. The sustain period increases in the ratio of $2^n$ (where, n=0, 1, 2, 3, 4, 5, 6, 7) in each of the sub-fields. As such, since the sustain period varies in each sub-field, the gray level of an image is represented by controlling the sustain period of each of the sub-fields, i.e., the number of the sustain discharge. A driving waveform depending upon the method of driving the plasma display panel will now be described with reference to FIG. 3.

FIG. 3 shows a driving waveform in the driving method of the conventional plasma display apparatus.

Referring to FIG. 3, the conventional plasma display apparatus is driven with it being divided into a reset period for initializing all cells, an address period for selecting cells to be discharged, a sustain period for maintaining discharging of selected cells, and an erase period for erasing wall charges within discharged cells.

In a set-up period of the reset period, a set-up waveform constituting ramp-up (Ramp-up) is applied to the plurality of scan electrodes Y at the same time. The set-up waveform causes a set-up discharge generating a weak dark discharge to occur within discharge cells of the entire screen. The set-up discharge causes positive wall charges to be accumulated on the address electrodes X and the sustain electrode Z, and negative wall charges to be accumulated on the scan electrodes Y. At this time, the sustain electrode Z refer to the sustain electrodes.

In a set-down period, after the set-up waveform is applied, a set-down waveform constituting a ramp-down (Ramp-down), which falls from a positive polarity voltage lower than a peak voltage of the set-up waveform to a predetermined voltage lower than a ground GND level voltage, is applied. As the set-down waveform is applied, a set-down discharge generating a weak erase discharge is generated within the cells. Thus, wall charges that are excessively formed on the scan electrodes are sufficiently erased by means of the set-down discharge. The set-down discharge also causes wall charges of the degree that an address discharge can be stably generated to uniformly remain within the cells.

In the address period, while a negative scan waveform is sequentially applied to the scan electrodes Y, a positive data waveform is applied to the address electrodes X in synchronization with the scan waveform. As a voltage difference between the scan waveform and the data waveform and the wall voltage generated in the reset period are added, an address discharge is generated within discharge cells to which the data waveform is applied. Furthermore, wall charges of the degree that causes a discharge to be generated when a sustain voltage Vs is applied are formed within cells selected by the address discharge. To the sustain electrode Z is applied a positive voltage Vz, which prevents generation of erroneous discharge with the Y electrode through reduction of a voltage difference with the Y electrode during the set-down period and the address period.

In the sustain period, a sustain waveform sus is applied to one or more of the scan electrodes Y and the sustain electrode Z. In cells selected by the address discharge, a sustain discharge, i.e., a display discharge is generated between the scan electrodes Y and the sustain electrode Z as a wall voltage within the cells and the sustain waveform are added whenever the sustain waveform is applied.

In addition, after the sustain discharge is completed, in the erase period, an erase waveform constituting erase ramp (Ramp-ers) having a small pulse width and a low voltage level is applied to the sustain electrode, thus erasing wall charges remaining within the cells of the entire screen. In this conventional driving waveform, the sustain waveform supplied in the sustain period will be described in more detail with reference to FIG. 4.

FIG. 4 is a view illustrating, in more detail, a sustain pulse supplied in a sustain period in a conventional driving waveform.

Referring to FIG. 4, in the sustain waveform supplied in the sustain period in the conventional driving waveform, if a sustain voltage (Vs) is applied to the scan electrodes Y with a voltage of a ground level (GND) being applied to the sustain electrode Z, sustain discharge is generated by means of the scan electrodes Y. To the contrary, if the sustain voltage (Vs) is applied to the sustain electrode Z with a voltage of the ground level (GND) being applied to the scan electrodes Y, sustain discharge is generated by means of the sustain electrode Z. It is common that this sustain waveform is alternately supplied to a sustain electrode pair in which the scan electrodes Y and the sustain electrode Z form a pair.

This conventional sustain waveform rises at a predetermined tilt in the rising time (ER-Up Time), and falls at a predetermined tilt in the falling time (ER-Down Time). In this case, the aforementioned rising time can be a period where a voltage rises from the ground level (GND) to the sustain voltage (Vs) as shown in, e.g., FIG. 4. The aforementioned falling time can be a period where a voltage falls from the sustain voltage (Vs) to the ground level (GND).

Meanwhile, as a temperature of the plasma display panel changes, a discharge firing voltage (Vth) upon driving is varied. This will be described with reference to a discharge firing voltage closed curve (Vt closed curve) as shown in FIG. 5.

FIG. 5 is a view illustrating variations in a discharge firing voltage depending on a temperature of the plasma display panel.

The discharge firing voltage closed curve (Vt closed curve) of FIG. 5 shows a discharge firing voltage depending on a voltage difference between electrodes, which is represented by a curve, when a voltage is applied to the address electrodes X, the scan electrodes Y and the sustain electrode Z, respectively. If a voltage difference between the electrodes goes out the closed curve, discharging begins within discharge cells.

In this case, the higher the temperature of the plasma display panel, the greater the size of the discharge firing voltage closed curve. Furthermore, the lower the temperature of the plasma display panel, the smaller the size of the discharge firing voltage closed curve. Variations in the size of the discharge firing voltage closed curve refer to variations in the discharge firing voltage when the plasma display panel is driven. Accordingly, if a temperature of the plasma display panel rises, the discharge firing voltage rises. If a temperature of the plasma display panel falls, the discharge firing voltage drops.

This is generally generated as the recombination ratio between wall charges and space charges within discharge cells is varied depending on a temperature of the plasma display panel. This will be described below with reference to FIG. 6.

FIG. 6 is a view illustrating variations in the distribution of wall charges depending on a temperature of the conventional plasma display panel.

Referring to FIG. 6, if a temperature of the plasma display panel in the plasma display panel operating according to the driving waveform in the conventional driving method rises, the ratio that space charges 601 and wall charges 600 are recombined within the discharge cells increases. Thus, the absolute amount of wall charges participating in discharging is reduced. Accordingly, when a temperature of the panel is high, erroneous discharge is generated. That is, high temperature erroneous discharge is generated.

For example, when a temperature of the panel is high, the recombination ratio between the space charges 601 and the wall charges 600 in the address period increases and the amount of the wall charges 600 taking part in address discharging is reduced accordingly. This results in unstable address discharging. In this case, as the sequence of addressing is late, a time where the space charges 601 and the wall charges 600 can be recombined is sufficiently secured. This makes address discharging further unstable. Accordingly, the intensity of sustain light generated by the conventional sustain waveform shown in FIG. 4 is reduced, or what is worse, high temperature erroneous discharge, such as that discharge cells turned on in the address period are turned off in the sustain period, is generated.

Furthermore, when a temperature of the panel is relatively low, the recombination ratio between the space charges 601 and the wall charges 600 relatively reduces. This too much increases the amount of wall charges within the discharge cells. Accordingly, when a temperature of the panel is relatively low, the intensity of sustain light generated by the conventional sustain waveform of FIG. 4 excessively increases, or what is worse, low temperature erroneous discharge, such as that defective hot spots are generated, is generated.

Sustain light generated by the sustain waveform when a temperature of the plasma display panel is low or high, as described above, will be described below with reference to FIG. 7.

FIG. 7 is a view illustrating sustain light generated by a conventional sustain pulse when a temperature of the plasma display panel is high or low.

Referring to FIG. 7, in the conventional sustain waveform, the rising time and the falling time of the waveform keep constant regardless of a temperature of the plasma display panel. Accordingly, when a temperature of the panel is relatively high or relatively low, the intensity of sustain light is varied.

In other words, as shown in FIG. 7, in the case where the rising time of the sustain waveform keeps constant, if a temperature of the plasma display panel rises higher than room temperature, the intensity of sustain light generated by the sustain waveform becomes relatively weaker than in (b) (i.e., room temperature), as shown in (a). This is because the ratio in which the wall charges and the space charges are recombined within the discharge cells increases, as described with reference to FIG. 6, and the amount of the wall charges within the discharge cells reduces accordingly. Therefore, there is a problem in that brightness of the plasma display panel reduces.

Furthermore, in the event that the rising time of the sustain waveform keeps constant as shown in FIG. 7, if a temperature of the plasma display panel drops below room temperature, the intensity of sustain light generated by the sustain waveform relatively increases than in (b) (i.e., room temperature), as shown in (c). This is because the ratio in which the wall charges and the space charges are recombined within the discharge cells reduces, as described with reference to FIG. 6, and the amount of the wall charges within the discharge cells excessively increases accordingly. Accordingly, there is a problem in that defective hot spots are generated on the screen and the picture quality is degraded accordingly since the brightness of the plasma display panel abruptly increases.

In addition, if the amount of wall charges within discharge cells abruptly increases, after the conventional sustain waveform drops from the sustain voltage (Vs) to the ground level (GND) in the falling time (ER-Down Time) and generates self erase due to the excessively increased wall charges. This causes to reduce the amount of the wall charges within the discharge cells. Accordingly, when a subsequent sustain waveform is supplied, the amount of wall charges within the discharge cells becomes short of. Therefore, there is a problem in that the intensity of sustain light generated by the subsequent sustain waveform becomes weak or what is worse, sustain discharge is not generated. Consequently, the picture quality of the plasma display panel is degraded.

SUMMARY OF THE INVENTION

Accordingly, the present invention has been made in view of the above problems occurring in the prior art, and it is an object of the present invention to provide a plasma display apparatus and driving method thereof, wherein erroneous discharge depending on a temperature of a plasma display panel can be prevented.

Another object of the present invention is to provide a plasma display apparatus and driving method thereof, wherein a reduction in brightness can be prohibited.

Further another object of the present invention is to provide a plasma display apparatus and driving method thereof, wherein generation of defective hot spots can be prevented.

Still another object of the present invention is to provide a plasma display apparatus and driving method thereof, wherein self erase can be prohibited.

To achieve the above objects, according to one aspect of the present invention, there is provided a plasma display apparatus including a plasma display panel comprising a plurality of sustain electrode pairs wherein each of the sustain electrode pairs has a scan electrode and a sustain electrode, and a sustain waveform controller for controlling a rising time or a falling time of sustain waveforms supplied to at least one of the sustain electrode pairs according to a temperature of the plasma display panel.

A plasma display apparatus according to the present invention includes a plasma display panel comprising a plurality of sustain electrode pairs wherein each of the sustain electrode pairs has a scan electrode and a sustain electrode, and a sustain waveform controller for controlling a time corresponding to a time point at which a sustain discharge is generated, of a rising time and a falling time of sustain waveforms supplied to at least one of the sustain electrode pairs, according to a temperature of the plasma display panel.

According to another aspect of the present invention, there is also provided a method of driving a plasma display apparatus, wherein images of a plasma display panel are implemented by applying a sustain waveform to a plurality of sustain electrode pairs wherein each of sustain electrode pairs has a scan electrode and a sustain electrode, the method includes the steps of (a) detecting a temperature of the plasma display panel, and (b) controlling a rising time or a falling time of a sustain waveform applied to at least one of the sustain electrode pairs according to the temperature.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

The present invention will now be described in detail in connection with preferred embodiments with reference to the accompanying drawings.

First Embodiment

Figure 1:
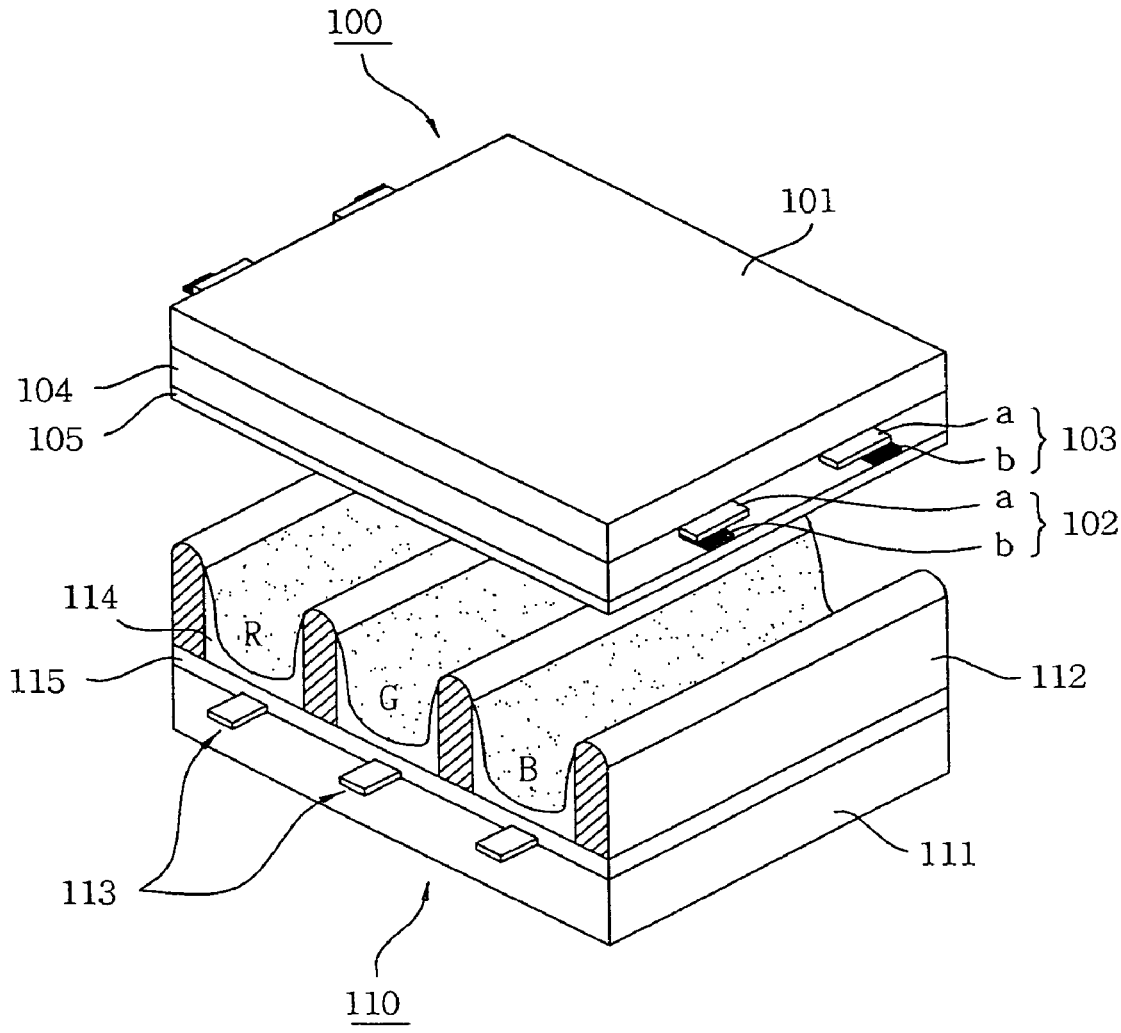
FIG. 1 shows the construction of a common plasma display panel.
Figure 2:
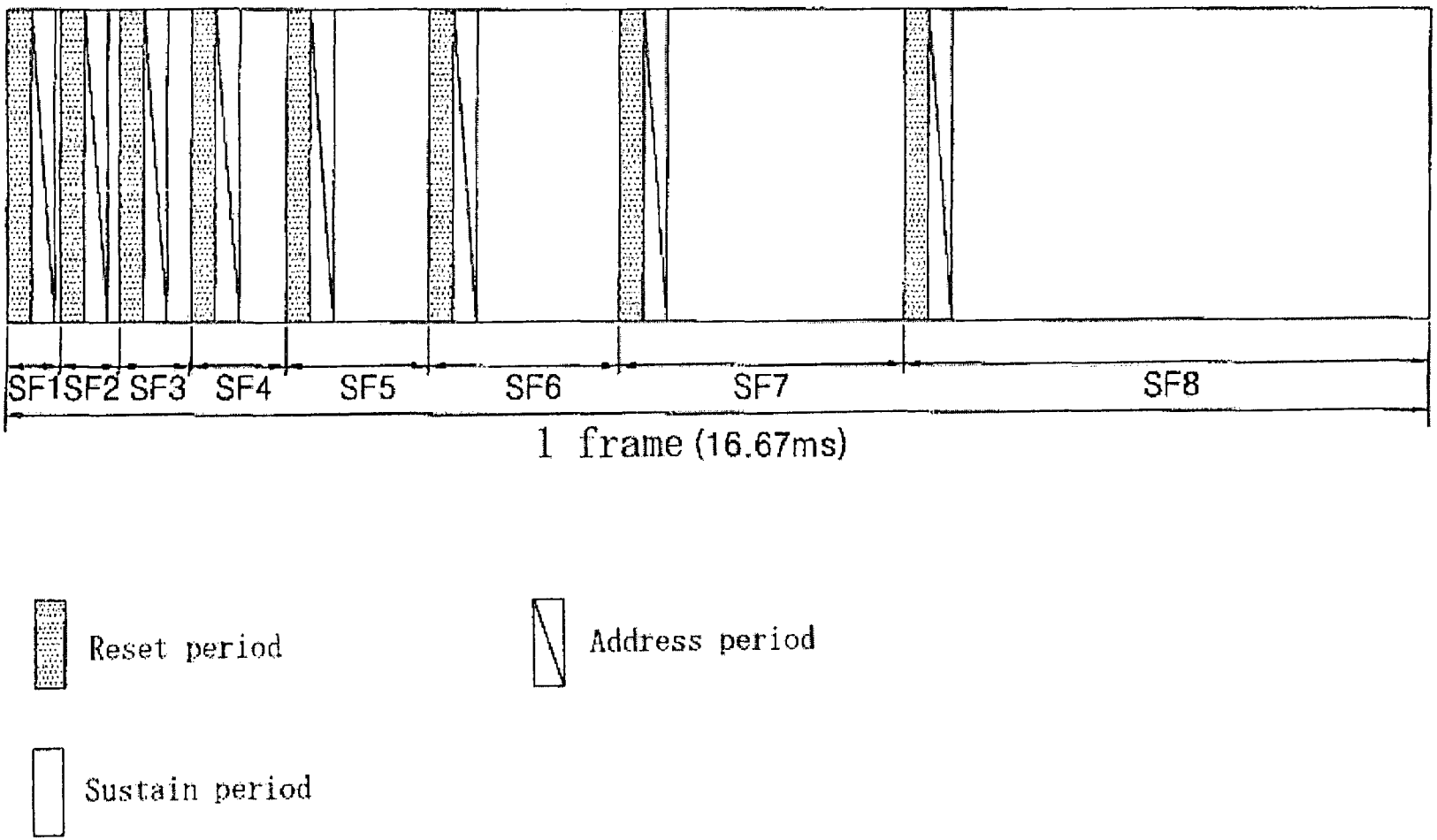
FIG. 2 is a view for illustrating a method of implementing image gray levels of a conventional plasma display apparatus.
Figure 3:
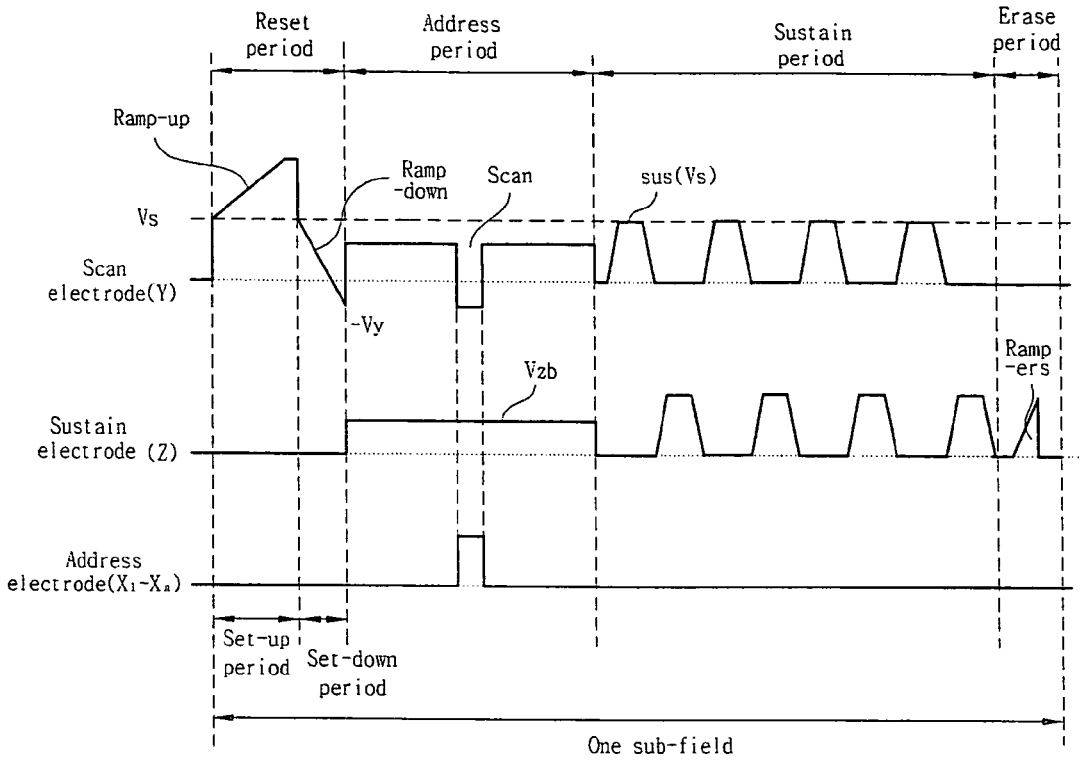
FIG. 3 shows a driving waveform in the driving method of the conventional plasma display apparatus.
Figure 4:
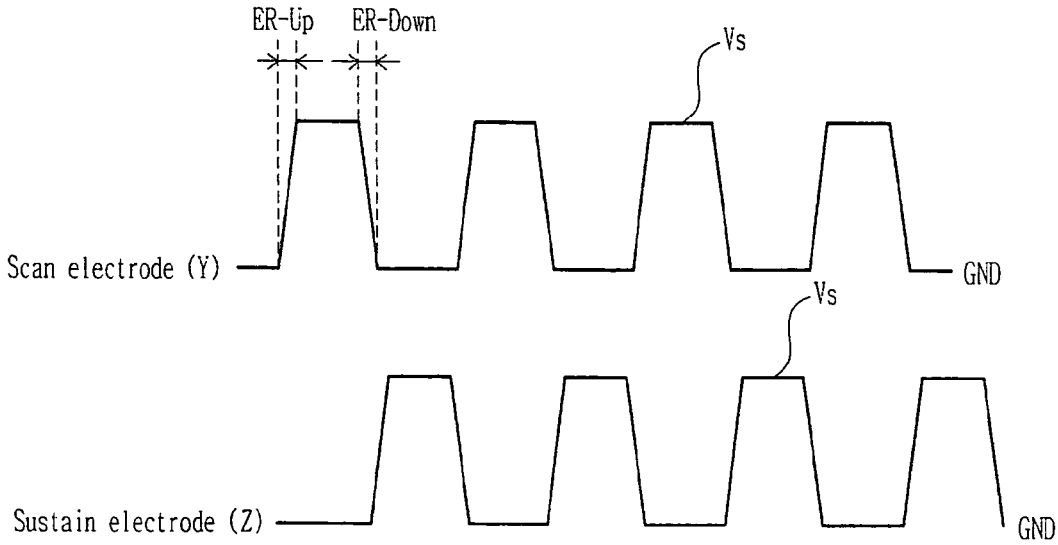
FIG. 4 is a view illustrating, in more detail, a sustain pulse supplied in a sustain period in a conventional driving waveform.
Figure 5:
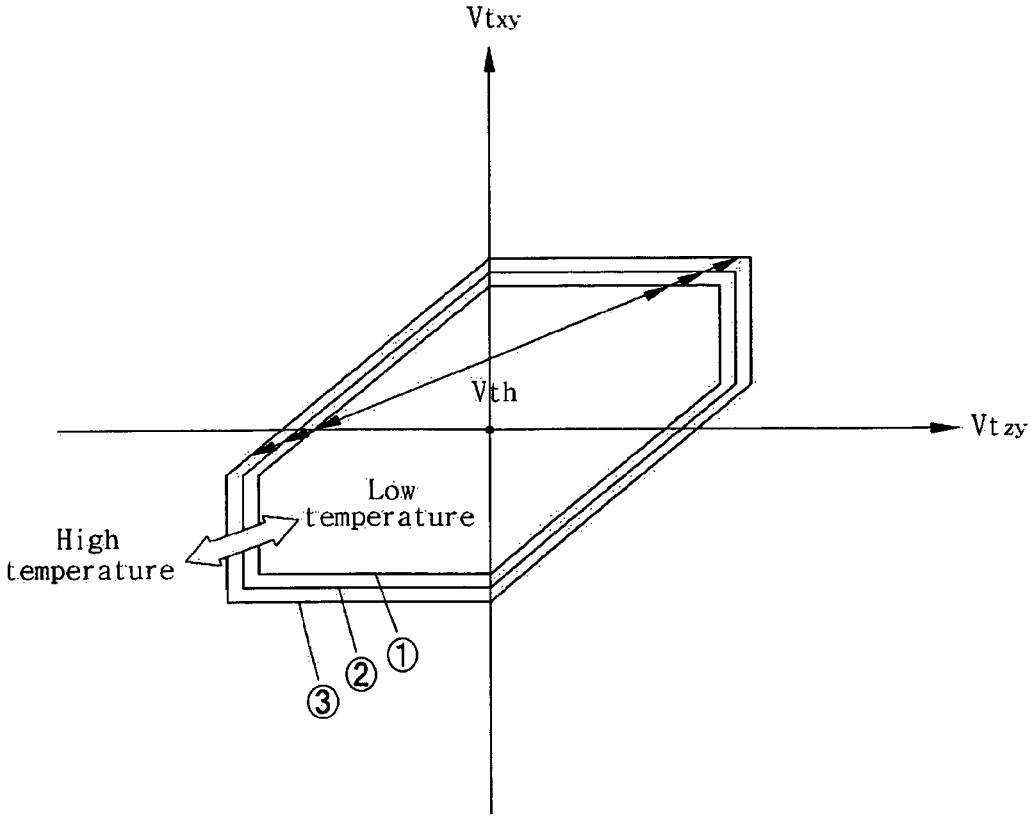
FIG. 5 is a view illustrating variations in a discharge firing voltage depending on a temperature of the plasma display panel.
Figure 6:
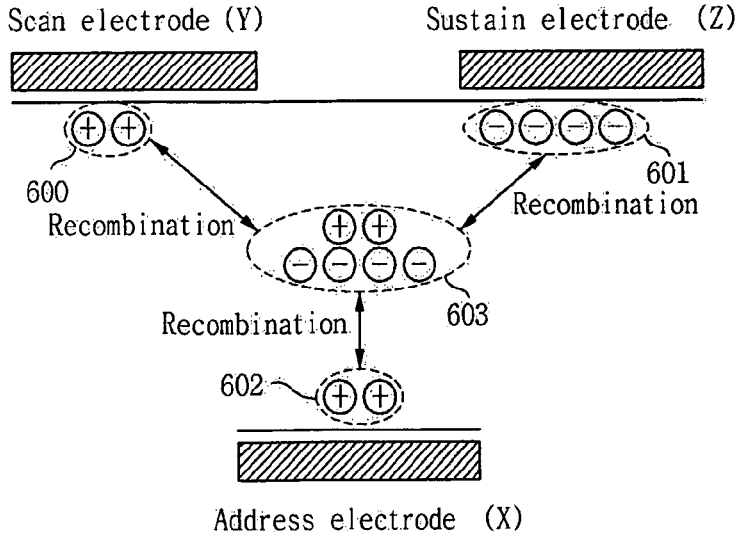
FIG. 6 is a view illustrating variations in the distribution of wall charges depending on a temperature of the conventional plasma display panel.
Figure 7:
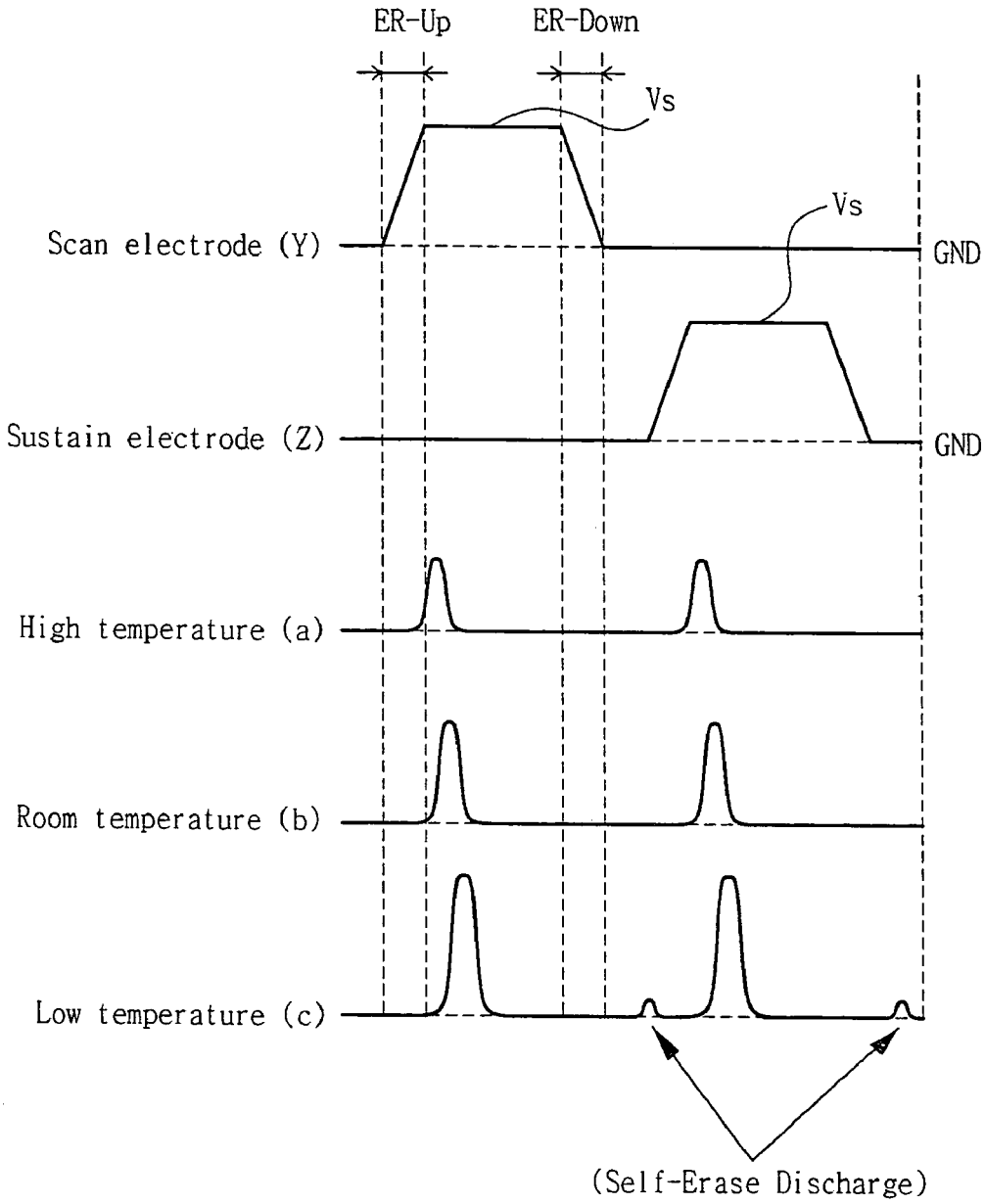
FIG. 7 is a view illustrating sustain light generated by a conventional sustain pulse when a temperature of the plasma display panel is high or low.
Figure 8:
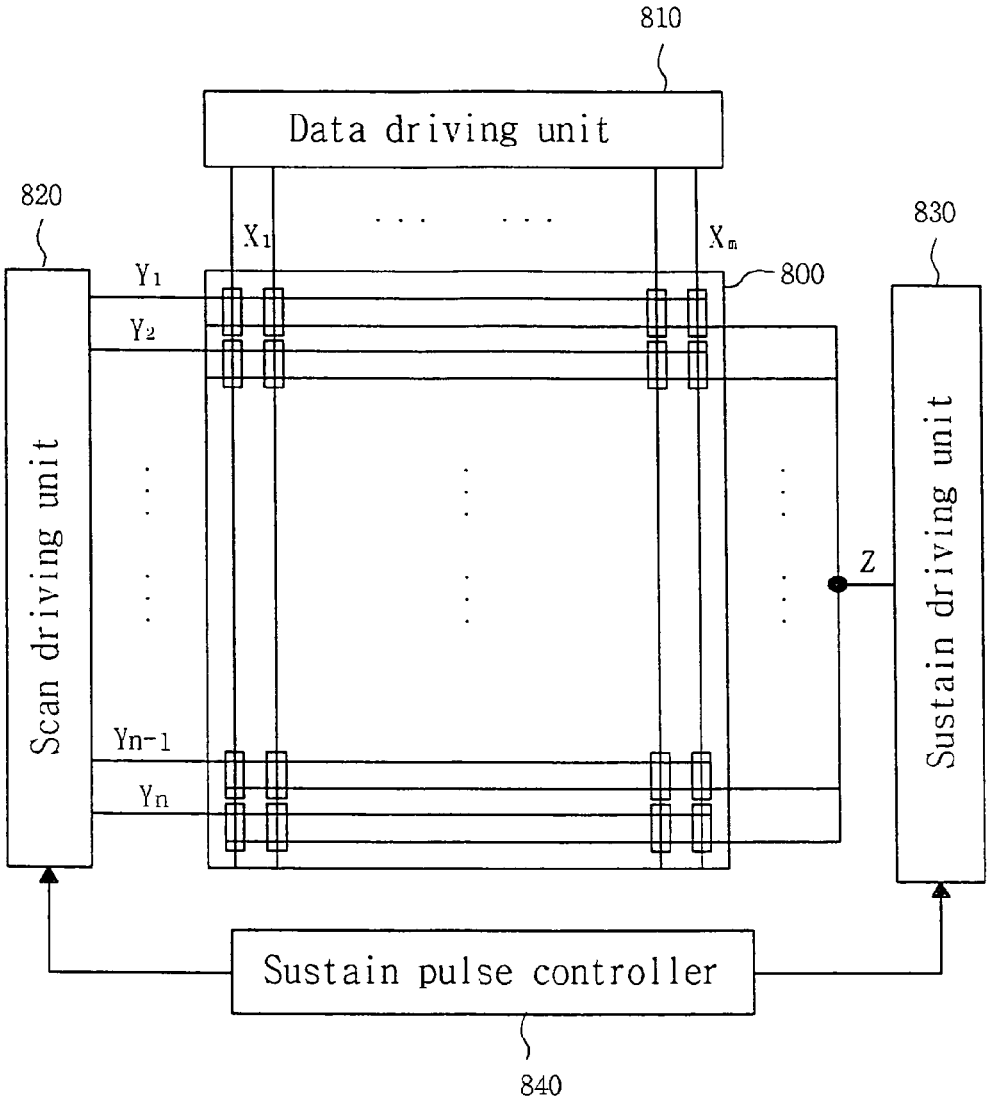
FIG. 8 shows the construction of a plasma display apparatus according to a first embodiment of the present invention.

FIG. 8 shows the construction of a plasma display apparatus according to a first embodiment of the present invention.

Referring to FIG. 8, the plasma display apparatus according to a first embodiment of the present invention includes a plasma display panel 800, a data driving unit 810, a scan driving unit 820, a sustain driving unit 830 and a sustain waveform controller 840.

The plasma display panel 800 has a front panel (not shown) and a rear panel (not shown) combined together with a predetermined distance therebetween. A plurality of sustain electrode pairs, each having a number of electrodes such as scan electrodes $Y_1$ to Yn and a sustain electrode Z, is formed in the front panel. Further, address electrodes $X_1$ to Xm are formed in the rear panel in such a way as to cross the sustain electrode pairs.

The data driving unit 810 is supplied with image data, which are inversely corrected and error diffused by means of an inverse gamma correction circuit, an error diffusion circuit, etc. and are then mapped to each sub-field by means of a sub-field mapping circuit. The data driving unit 810 supplies the sub-field mapped image data to corresponding address electrodes X.

The scan driving unit 820 supplies a set-up pulse constituting a ramp-up waveform (Ramp-up) to the scan electrodes $Y_1$ to Yn during a set-up period of a reset period and a set-down pulse constituting a ramp-down waveform (Ramp-down) to the scan electrodes $Y_1$ to Yn during a set-down period of the reset period. Furthermore, the scan driving unit 820 sequentially supplies a scan pulse (Sp) of the scan voltage (−Vy) to the scan electrodes $Y_1$ to Yn during the address period and the sustain waveform (SUS) to the scan electrodes $Y_1$ to Yn during a sustain period, under the control of the sustain waveform controller 840.

The sustain driving unit 830 supplies a bias voltage (Vz) to the sustain electrode Z during one or more of the set-down period and the address period, and supplies the sustain waveform (SUS) to the sustain electrode Z while operating alternately with the scan driving unit 820 in the sustain period under the control of the sustain waveform controller 840.

The sustain waveform controller 840 controls the operation of each of the scan driving unit 820 and the sustain driving unit 830 in the sustain period. More particularly, the sustain waveform controller 840 according to a first embodiment of the present invention controls the scan driving unit 820 and the sustain driving unit 830 to control at least one of a rising time and a falling time of a sustain waveform, which is supplied to at least one of the scan electrodes $Y_1$ to Yn and the sustain electrode Z according to a temperature of the plasma display panel 800. The operation of the plasma display apparatus constructed above according to a first embodiment of the present invention will be described below in more detail with reference to FIGS. 9*a* to 13*b*.

Figure 9A:
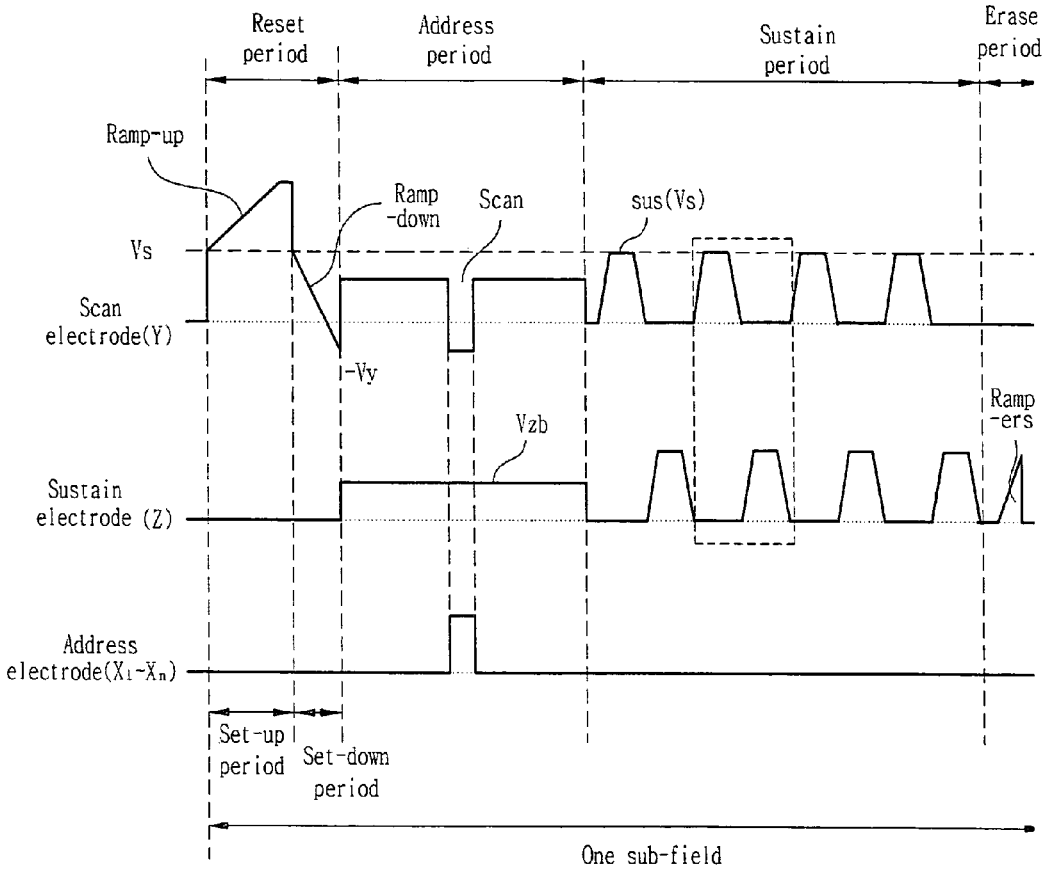
FIGS. 9*a* and 9*b* are views for illustrating a driving waveform of the plasma display apparatus according to a first embodiment of the present invention.
Figure 9B:
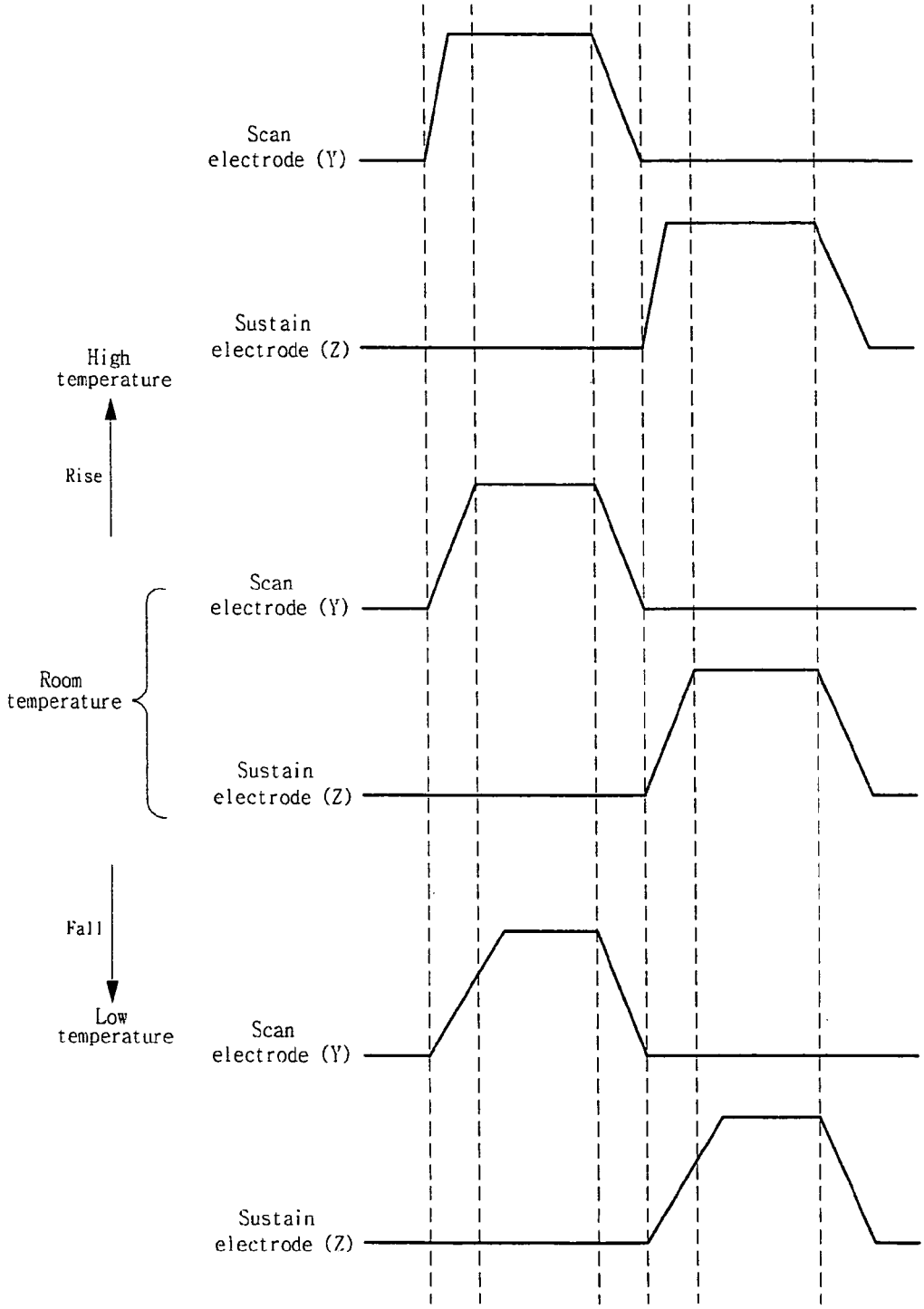

FIGS. 9*a* and 9*b* are views for illustrating a driving waveform of the plasma display apparatus according to a first embodiment of the present invention. FIG. 9*a* shows a waveform applied during one sub-field of the plasma display apparatus according to a first embodiment of the present invention. FIG. 9*b* shows a sustain waveform supplied in the sustain period of FIG. 9*a*.

Referring to FIG. 9*a*, the plasma display apparatus according to a first embodiment of the present invention is driven with it being divided into a reset period for initializing all cells, an address period for selecting cells to be discharged, a sustain period for maintaining discharging of selected cells, and an erase period for erasing wall charges within discharged cells.

In a set-up period of the reset period, a set-up waveform constituting ramp-up (Ramp-up) is applied to the plurality of scan electrodes Y at the same time. A set-up discharge generating a weak dark discharge is generated within discharge cells of the entire screen by means of the set-up waveform. The set-up discharge causes wall charges of the positive polarity to be accumulated on the address electrodes X and the sustain electrode Z, and wall charges of the negative polarity to be caused on the scan electrodes Y. At this time, the sustain electrode Z refer to the sustain electrodes.

In a set-down period, after the set-up waveform is applied, a set-down waveform constituting a ramp-down (Ramp-down), which falls from a positive polarity voltage lower than a peak voltage of the set-up waveform to a predetermined voltage lower than a ground GND level voltage, is applied. As the set-down waveform is applied, a set-down discharge generating a weak erase discharge is generated within the cells. Thus, wall charges that are excessively formed on the scan electrodes are sufficiently erased by means of the set-down discharge. The set-down discharge also causes wall charges of the degree that an address discharge can be stably generated to uniformly remain within the cells.

In the address period, while a negative scan waveform is sequentially applied to the scan electrodes Y, a positive data waveform is applied to the address electrodes X in synchronization with the scan waveform. As a voltage difference between the scan waveform and the data waveform and the wall voltage generated in the reset period are added, an address discharge is generated within discharge cells to which the data waveform is applied. Furthermore, wall charges of the degree that causes a discharge to be generated when a sustain voltage Vs is applied are formed within cells selected by the address discharge. To the sustain electrode Z is applied a positive voltage Vz, which prevents generation of erroneous discharge with the Y electrode through reduction of a voltage difference with the Y electrode during the set-down period and the address period.

In the sustain period, a sustain waveform sus is applied to one or more of the scan electrodes Y and the sustain electrode Z. In cells selected by the address discharge, a sustain discharge, i.e., a display discharge is generated between the scan electrodes Y and the sustain electrode Z as a wall voltage within the cells and the sustain waveform are added whenever the sustain waveform is applied.

In the first embodiment of the present invention, at least one of the rising time and the falling time of the sustain waveform supplied to at least one of the scan electrodes Y and the sustain electrode Z during the sustain period is controlled according to a temperature of the plasma display panel. At this time, sustain discharge is generated in the rising time (ER-Up-Time) of the sustain waveform supplied to the scan electrodes Y and the sustain electrode Z, respectively. Accordingly, controlling the rising time where sustain discharge is generated according to a temperature of the plasma display panel is effective in controlling sustain light.

In addition, after the sustain discharge is completed, in the erase period, an erase waveform constituting erase ramp (Ramp-ers) having a small pulse width and a low voltage level is applied to the sustain electrode, thus erasing wall charges remaining within the cells of the entire screen.

As shown in FIG. 9*b*, if a temperature of the plasma display panel is higher than room temperature, the rising time (ER-Up-time) of the sustain waveform, each supplied to the scan electrodes Y and the sustain electrode Z, is made shorter than that at room temperature. Furthermore, if a temperature of the plasma display panel is lower than room temperature, the rising time (ER-Up-time) of the sustain waveform, each supplied to the scan electrodes Y and the sustain electrode Z, is made longer than that at room temperature.

Figure 10:
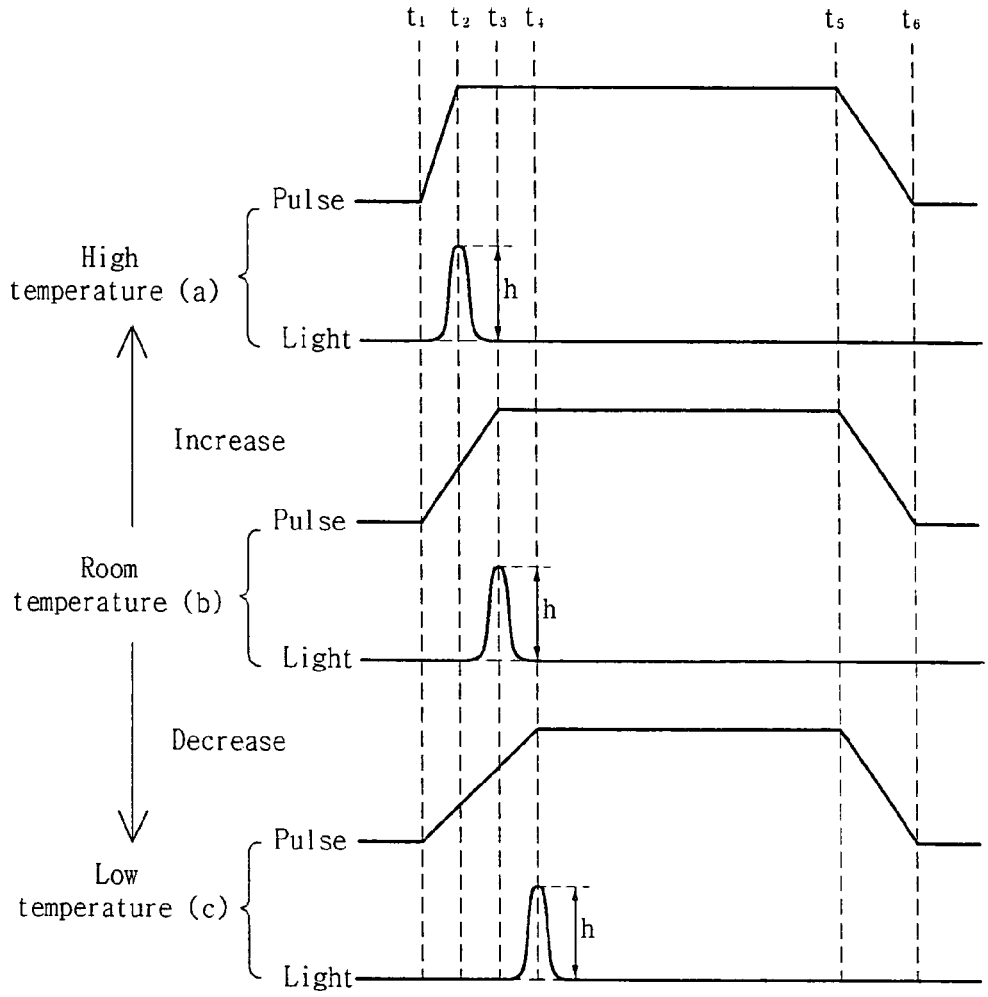
FIG. 10 is a view for illustrating a sustain light characteristic of the sustain waveform of the plasma display apparatus according to a first embodiment of the present invention.

FIG. 10 is a view for illustrating a sustain light characteristic of the sustain waveform of the plasma display apparatus according to a first embodiment of the present invention.

As shown in FIG. 10, in the first embodiment of the present invention, the rising time of the sustain waveform, each supplied to the scan electrodes Y and the sustain electrode Z, is controlled according to a temperature of the plasma display panel.

For example, the sustain waveform supplied to at least one of the scan electrodes Y and the sustain electrode Z when a temperature of the plasma display panel is room temperature starts rising at a time point $t_1$ and reaches the highest point at a time point $t_3$. In other words, the rising time of the sustain waveform is $t_3-t_1$ at room temperature.

Furthermore, the sustain waveform supplied to at least one of the scan electrodes Y and the sustain electrode Z when a temperature of the plasma display panel is higher than the room temperature starts rising at the time point $t_1$ and then reaches the highest point at the time point $t_2$. That is, the rising time of the sustain waveform at high temperature is $t_2-t_1$.

Furthermore, the sustain waveform supplied to at least one of the scan electrodes Y and the sustain electrode Z when a temperature of the plasma display panel is lower than the room temperature starts rising at the time point $t_1$ and then reaches the highest point at the time point $t_4$. That is, the rising time of the sustain waveform at low temperature is $t_4-t_1$.

Meanwhile, the falling time of the sustain waveform will be described below. The sustain waveform supplied to one or more of the scan electrodes Y and the sustain electrode Z in the sustain period when a temperature of the plasma display panel is high and low starts falling at a time point $t_5$ and then reaches the lowest point at a time point $t_6$. In other words, the falling time of the sustain waveform at high temperature and low temperature is $t_6-t_5$.

As described above, in the first embodiment of the present invention, the falling time (ER-Down Time) of the sustain waveform supplied to one or more of the scan electrodes Y and the sustain electrode Z during the sustain period is kept constant regardless of a temperature of the plasma display panel. It has been described above that only the rising time of the sustain waveform is controlled. Unlike the above, the falling time can be controlled together with the rising time. This will be described in detail later on.

Meanwhile, regarding a sustain light characteristic depending on a temperature of FIG. 10, compared with the conventional sustain light characteristic, the amount of sustain light generated by the sustain waveform when a temperature of the plasma display panel is high and low is the same as that when a temperature of the plasma display panel is room temperature. In this case, the reason why the amount of sustain light at high temperature, room temperature and low temperature is the same will be described below.

That is, as in (a) of FIG. 10, when a temperature of the plasma display panel is higher than room temperature, the rising time of the sustain waveform supplied to at least one of the scan electrodes Y and the sustain electrode Z in the sustain period is controlled to be shorter than those at room temperature, i.e., (b). Thus, sustain discharge generated by one sustain waveform is generated rapidly. Accordingly, the intensity of sustain light generated by one sustain waveform increases. Consequently, when a temperature of the plasma display panel is higher than room temperature, the ratio in which wall charges are recombined with space charges within discharge cells is increased. Therefore, before the amount of wall charges within the discharge cells is reduced, sustain discharge is generated rapidly. It is thus possible to increase the intensity of sustain light generated by one sustain waveform.

Accordingly, as in (a) of the conventional FIG. 8, the ratio in which wall charges within discharge cells are recombined with space charges is increased when a temperature of the plasma display panel is higher than room temperature. Therefore, an erroneous discharge problem generated as the amount of wall charges within discharge cells reduces, i.e., a problem such as that the intensity of sustain light generated by one sustain waveform reduces to reduce the brightness, and what is worse, sustain discharge is not generated is not generated.

Furthermore, as in (c) of FIG. 10, when a temperature of the plasma display panel is lower than room temperature, the rising time of the sustain waveform supplied to at least one of the scan electrodes Y and the sustain electrode Z in the sustain period is controlled to be longer than those at room temperature, i.e., (b). Thus, sustain discharge generated by one sustain waveform is relatively generated slowly. Accordingly, the intensity of one sustain light generated by one sustain waveform is reduced. Consequently, when a temperature of the plasma display panel is lower than room temperature, the ratio in which wall charges are recombined with space charges within discharge cells is reduced. Thus, although a relatively large amount of wall charges within the discharge cells is formed, sustain discharge is relatively generated slowly. It is thus possible to reduce the intensity of sustain light generated by one sustain waveform. It is also possible to prevent generation of defective hot spots.

Accordingly, as in (c) of the conventional FIG. 8, when a temperature of the plasma display panel is lower than room temperature, the ratio in which wall charges are recombined with space charges within discharge cells is reduced. Thus, a problem of erroneous discharge generated as a relatively large amount of wall charges within discharge cells is formed, i.e., a problem that the intensity of sustain light generated by one sustain waveform is excessively increased to generate defective hot spots on a screen, thus degrading the picture quality, is not generated.

Figure 11:
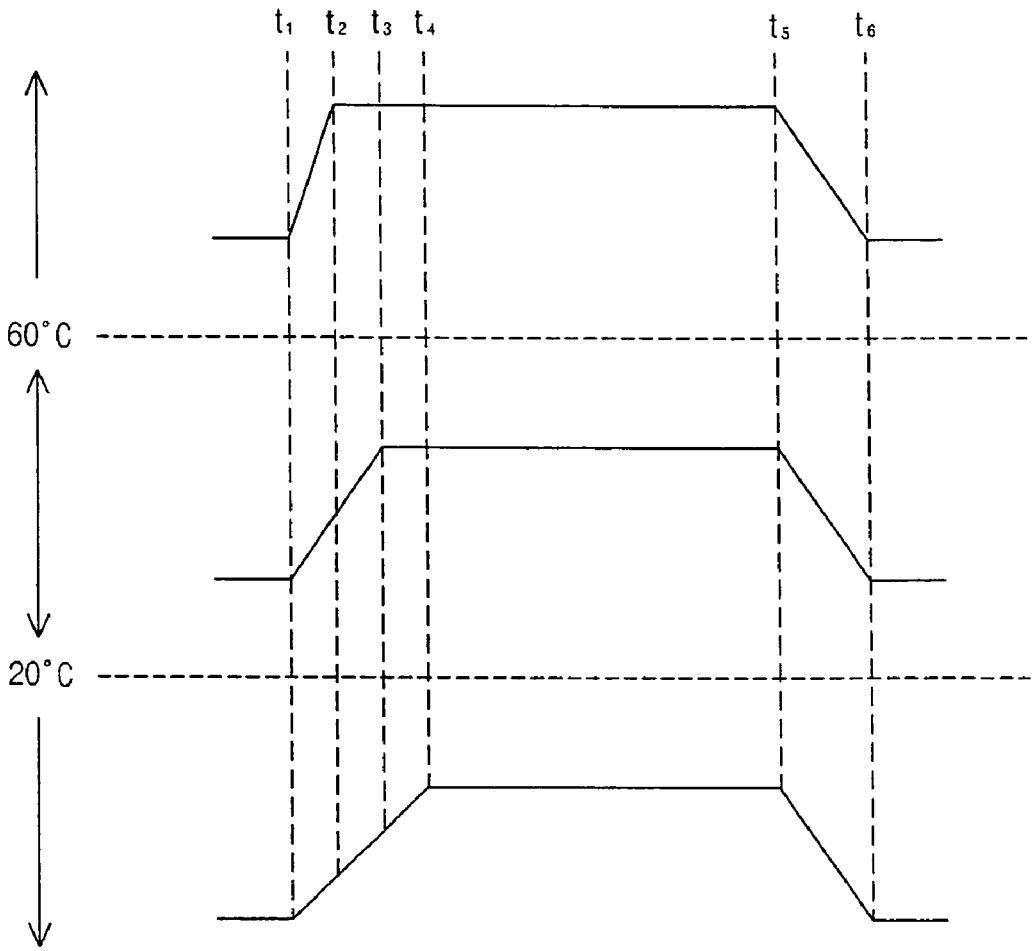
FIG. 11 is a view for illustrating another sustain waveform of the plasma display apparatus according to a first embodiment of the present invention.

FIG. 11 is a view for illustrating another sustain waveform of the plasma display apparatus according to a first embodiment of the present invention.

As shown in FIG. 11, in the first embodiment of the present invention, variations in a temperature of the plasma display panel is determined by comparing at least one or more critical temperatures with the temperature of the plasma display panel. A rising time or a falling time of the sustain waveform is controlled according to the determination result.

For example, the critical temperatures of the plasma display panel can be set to 20° C. and 60° C. That is, a first critical temperature of the plasma display panel, i.e., a high temperature critical temperature can be set to 60° C. and a second critical temperature of the plasma display panel, i.e., a low temperature critical temperature can be set to 20° C. The critical temperatures are set as described above, and the rising time or the rising time and the falling time of the sustain waveform supplied to the scan electrodes Y or the sustain electrode Z in the sustain period is controlled according to the set critical temperature.

For example, when a temperature of the plasma display panel is a low temperature critical temperature, e.g., below 20° C., the sustain waveform controller 840 of FIG. 8 senses that the temperature of the plasma display panel is low, and controls at least one of the rising time and the falling time of the sustain waveform, which is supplied to one or more of the scan electrodes Y and the sustain electrode Z in the sustain period, to be longer than that at room temperature. That is, the rising time of the sustain waveform is set to $(t_4-t_1)$, which is longer than a rising time $(t_3-t_1)$ of the sustain waveform at room temperature.

In this case, when a temperature of the plasma display panel is low, the rising time or the falling time of a sustain waveform can be 105% to 125% of a rising time or a falling time of a sustain waveform at room temperature. For example, assuming that a rising time of a sustain waveform at room temperature is 400 ns, a rising time of a sustain waveform when a temperature of the plasma display panel is low temperature is set within a range of 420 ns to 500 ns.

Furthermore, when a temperature of the plasma display panel is a high temperature critical temperature, e.g., 60° C. or higher, the sustain waveform controller 840 of FIG. 8 senses that the temperature of the plasma display panel is high, and controls the rising time and the falling time of the sustain waveform, which is supplied to sat least one of the scan electrodes Y or the sustain electrode Z in the sustain period, to be shorter than that at room temperature. That is, the rising time of the sustain waveform is set to $(t_2-t_1)$, which is shorter than a rising time $(t_3-t_1)$ of the sustain waveform at room temperature.

In this case, when a temperature of the plasma display panel is high, a rising time or a falling time of a sustain waveform can be 75% to 95% of a rising time or a falling time of a sustain waveform at room temperature. For example, assuming that a rising time of a sustain waveform at room temperature is 400 ns, a rising time of a sustain waveform when a temperature of the plasma display panel is low temperature is set within a range of 300 ns to 380 ns.

In addition, when a temperature of the plasma display panel is room temperature, i.e., over 20° C. to less than 60° C., the rising time of the sustain waveform is set to $(t_3-t_1)$. That is, the rising time of the sustain waveform is set to have three or more different values. In this manner, the rising time of the sustain waveform can be set to have six or more different values. This method is shown in FIG. 12.

Figure 12:
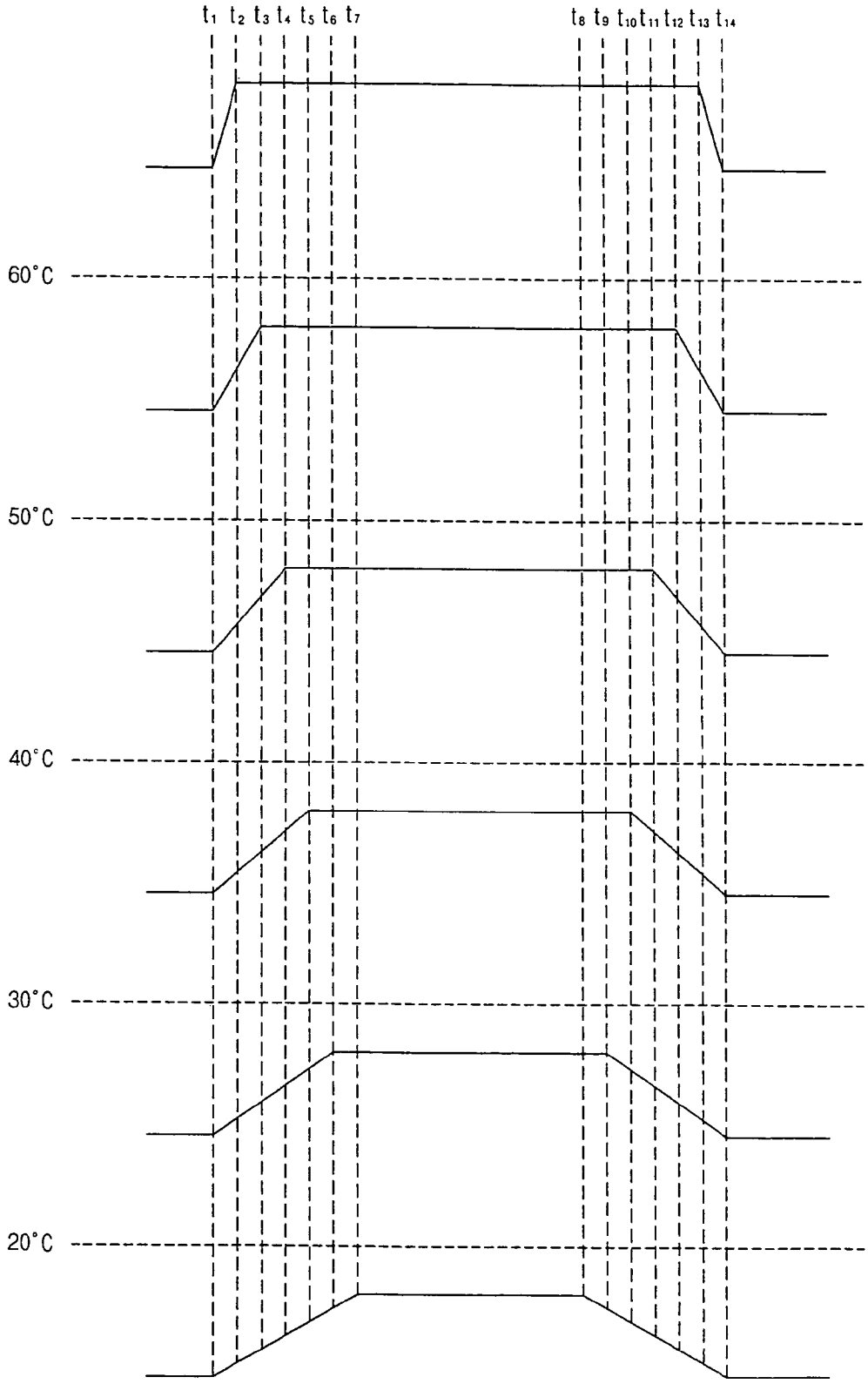
FIG. 12 is a view for illustrating further another sustain waveform of the plasma display apparatus according to a first embodiment of the present invention.

FIG. 12 is a view for illustrating further another sustain waveform of the plasma display apparatus according to a first embodiment of the present invention.

Referring to FIG. 12, unlike the case of FIG. 11, critical temperatures of the plasma display panel is set to five kinds; 20° C., 30° C., 40° C., 50° C. and 60° C. The critical temperatures are set as described above, and at least one of the rising time and the rising time and the falling time of the sustain waveform supplied to the scan electrodes Y or the sustain electrode Z in the sustain period is controlled according to the set critical temperature.

For example, as shown in FIG. 12, when a temperature of the plasma display panel is lower than 20° C., the sustain waveform controller 840 of FIG. 8 senses that the temperature of the plasma display panel is low, and controls the rising time and the falling time of the sustain waveform, which is supplied to at least one of the scan electrodes Y and the sustain electrode Z in the sustain period. As shown in the drawing, the sustain waveform controller 840 sets the rising time of the sustain waveform to $(t_7-t_1)$ and sets the falling time of the sustain waveform $(t_{14}-t_8)$.

Furthermore, as shown in FIG. 12, when a temperature of the plasma display panel ranges from 20° C. to 30° C., the sustain waveform controller 840 of FIG. 8 senses it and controls the rising time and the falling time of the sustain waveform, which is supplied to one or more of the scan electrodes Y and the sustain electrode Z in the sustain period. As shown in the drawing, the sustain waveform controller 840 sets the rising time of the sustain waveform to $(t_6-t_1)$ and sets the falling time of the sustain waveform to $(t_{14}-t_9)$.

In this manner, when a temperature of the plasma display panel ranges from 30° C. to 40° C., the sustain waveform controller 840 sets the rising time of the sustain waveform to $(t_5-t_1)$ and sets the falling time of the sustain waveform to $(t_{14}-t_{10})$. When a temperature of the plasma display panel ranges from 40° C. to 50° C., the sustain waveform controller 840 sets the rising time of the sustain waveform to $(t_4-t_1)$ and sets the falling time of the sustain waveform to $(t_{14}-t_{11})$. When a temperature of the plasma display panel ranges from 50° C. to 60° C., the sustain waveform controller 840 sets the rising time of the sustain waveform to $(t_3-t_1)$ and sets the falling time of the sustain waveform to $(t_{14}-t_{12})$. When a temperature of the plasma display panel is 60° C. or higher, the sustain waveform controller 840 sets the rising time of the sustain waveform to $(t_2-t_1)$ and sets the falling time of the sustain waveform to $(t_{14}-t_{13})$.

As described above, by setting the critical temperatures of the plasma display panel to plural steps, generation of erroneous discharge depending on a temperature can be prevented more easily.

Meanwhile, as shown in FIG. 12, in the first embodiment of the present invention, the lower the temperature of the plasma display panel, the greater the falling time of the sustain waveform. This is for preventing the amount of wall charges within discharge cells from reducing, which is incurred by generation of self erase discharge after a falling period of a sustain waveform, i.e., after a temperature of the plasma display panel drops from the sustain voltage (Vs) level to the ground level (GND) by means of wall charges excessively formed within the discharge cells as the temperature of the plasma display panel drops toward a low temperature.

In other words, when a temperature of the plasma display panel is lower than room temperature, the ratio that wall charges within discharge cells are recombined with space charges is reduced. Thus, even when the amount of wall charges within the discharge cells excessively increases, the falling time of the sustain waveform supplied to at least one of the sustain electrode Z and the scan electrodes Y is kept long compared to the prior art. Even after the temperature drops from the sustain voltage (Vs) to the ground level (GND) in a falling period of the sustain waveform, the distribution of wall charges within discharge cells can be stabilized. Thereby, a self-erase discharge is not generated.

In this case, a difference between rising times of the sustain waveform and a difference between rising times thereof in the range of each temperature in FIGS. 11 and 12 can be set to be the same or different from each other. It is thus preferred that a difference between the rising times and a difference between the falling times are the same in view of control of a driving circuit.

Figure 13A:
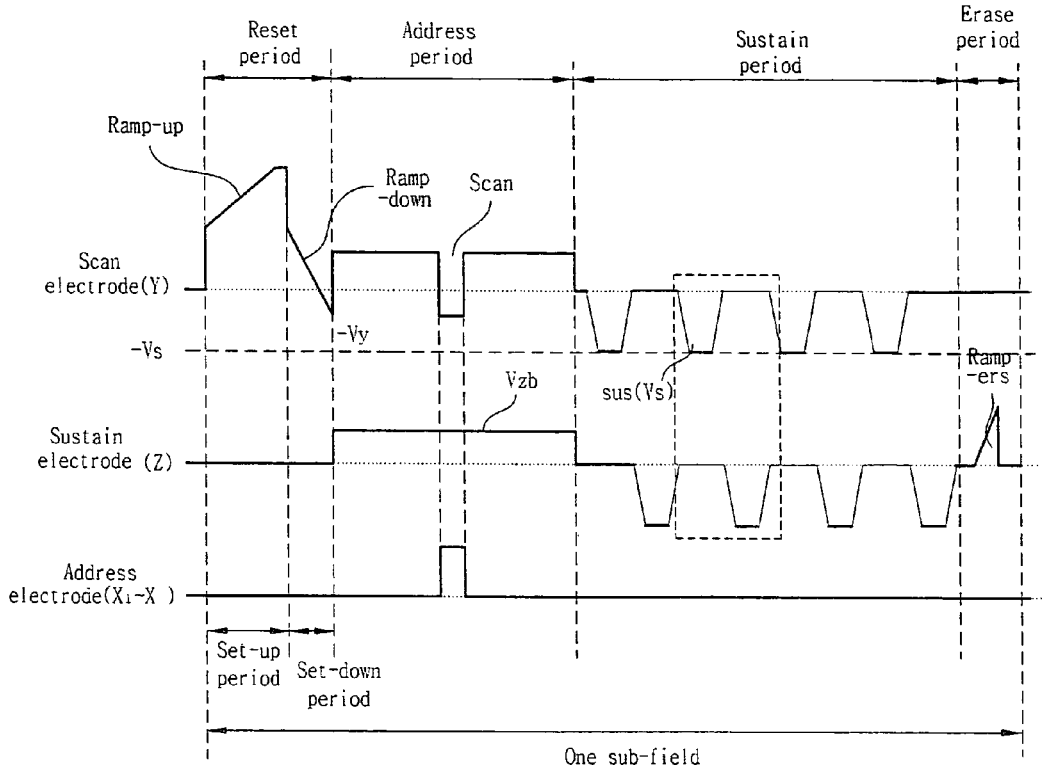
FIGS. 13*a* and 13*b* are views for illustrating still another driving waveform of the plasma display apparatus according to a first embodiment of the present invention.
Figure 13B:
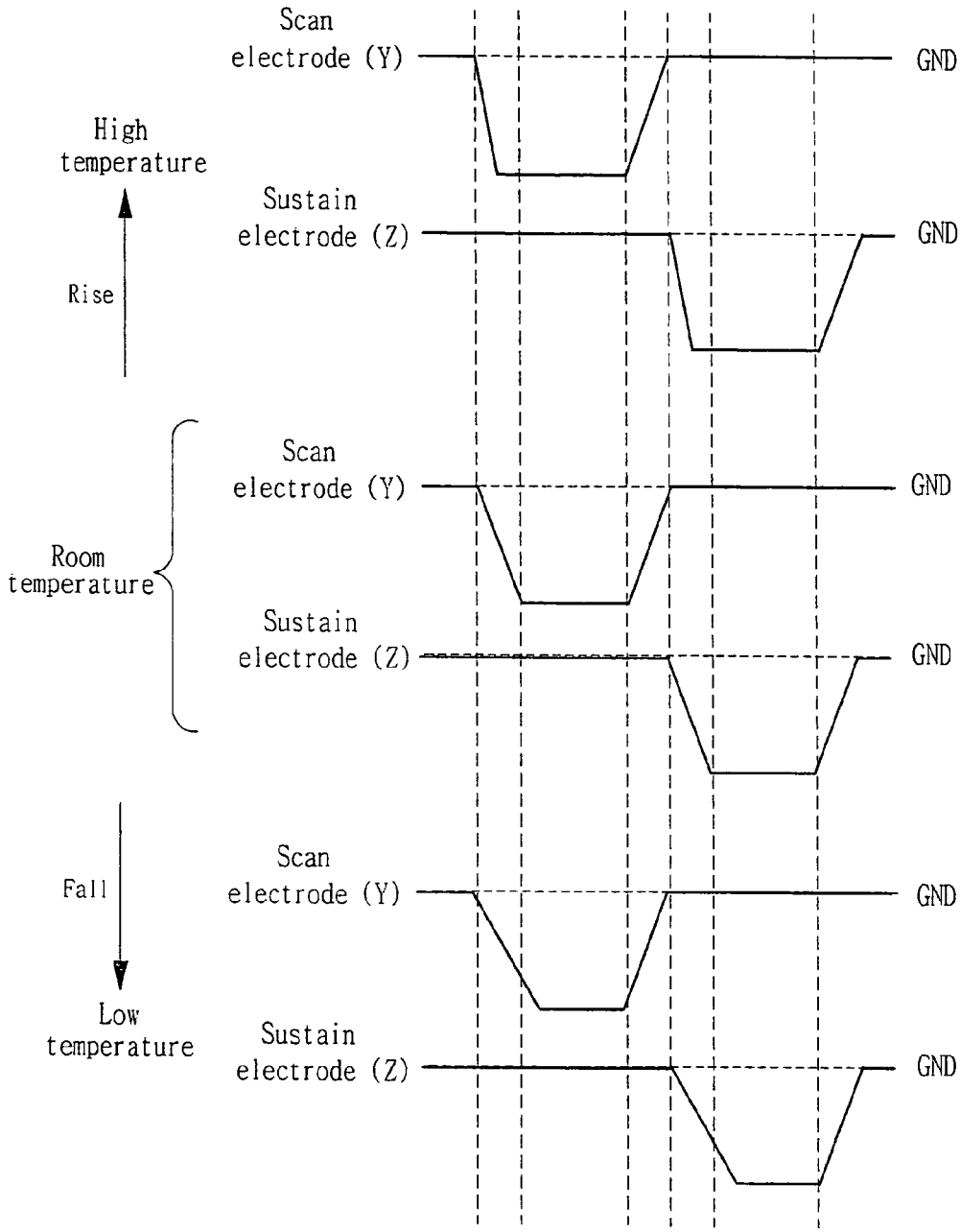

FIGS. 13*a* and 13*b* are views for illustrating still another driving waveform of the plasma display apparatus according to a first embodiment of the present invention. FIG. 13*a* shows a modified waveform applied during one sub-field in the plasma display apparatus according to a first embodiment of the present invention. FIG. 13*b* shows a negative sustain waveform supplied in the sustain period of FIG. 13*a*.

As shown in FIG. 13*a*, another driving waveform of the plasma display apparatus according to a first embodiment of the present invention is driven with it being divided into a reset period for initializing the entire cells, an address period for selecting a cell to be discharged, a sustain period for sustaining discharging of the selected cell, and an erase period for erasing wall charges within the cell to be discharged.

In this case, description on waveforms applied in the reset period, the address period and the erase period of FIG. 13*a* is the same as that on the waveforms applied in the reset period, the address period and the erase period of FIG. 9*a*. Description thereof will be omitted.

In the sustain period, a negative sustain waveform (Sus) is applied to one or more of the scan electrodes Y and the sustain electrode Z. The negative sustain driving method has a waveform in which a negative sustain voltage (−Vs) is applied to the scan electrodes Y or the sustain electrode Z of the front substrate and the ground voltage (GND) is applied to the address electrodes X of the rear substrate. At this time, prior to a surface discharge of the scan electrodes and the sustain electrode, an opposite discharge is generated between the scan electrodes or the sustain electrode and the address electrodes. Charges generated by an opposite discharge become a seed to a surface discharge. That is, positive (+) charges move toward the front substrate through the opposite discharge and collide against a magnesium oxide (MgO) protection layer, whereby secondary electrons are emitted. The secondary electrons serve as the seed of the surface discharge to generate more smooth surface discharge.

In a cell selected by address discharge in the sustain period, a sustain discharge, i.e., a display discharge is generated between the scan electrodes Y and the sustain electrode Z whenever every sustain waveform is applied as a wall voltage within the cell and the sustain waveform are added.

Even in further driving waveform of the first embodiment of the present invention, at least one of the rising time and the falling time of the sustain waveform supplied to at least one of the scan electrodes Y and the sustain electrode Z is controlled according to a temperature of the plasma display panel. At this time, a sustain discharge is generated in a falling time of a sustain waveform, which is a time point at which the sustain waveform is supplied to the scan electrodes Y and the sustain electrode Z, respectively. Therefore, controlling the falling time of the sustain discharge according to a temperature of the plasma display panel is effective in controlling sustain light.

As shown in FIG. 13*b*, when a temperature of the plasma display panel is higher than room temperature, a falling time of a sustain waveform respectively supplied to the scan electrodes Y and the sustain electrode Z is controlled to be shorter than that at room temperature. Furthermore, when a temperature of the plasma display panel is lower than room temperature, a falling time of a sustain waveform respectively supplied to the scan electrodes Y and the sustain electrode Z is controlled to be longer than that at room temperature.

In the plasma display apparatus according to a first embodiment of the present invention, at least one of a rising time or a falling time of a sustain waveform supplied to at least one of the sustain electrode pairs is controlled according to a temperature of the plasma display panel. In more detail, if a temperature rises, the rising time or the falling time is reduced, whereas if the temperature drops, the rising time or the falling time is increased. Furthermore, a critical temperature is set and variations in a temperature are determined according to the set critical temperature. The rising time or the falling time is adaptively controlled. In addition, a sustain discharge is mainly generated at a time point at which a sustain waveform is applied. The rising time or falling time of the sustain waveform is controlled accordingly. It is thus possible to improve the picture quality since erroneous discharge depending on a temperature.

Meanwhile, unlike the first embodiment of the present invention, the time point of the sustain discharge in the sustain waveform can be arbitrarily controlled depending on its overlapping degree. The plasma display apparatus and driving method thereof in which at least one of the falling time and the rising time of the sustain waveform is controlled according to a temperature of the plasma display panel at a time point at which controlled sustain discharge is generated will be described in a second embodiment of the present invention.

Second Embodiment

Figure 14:
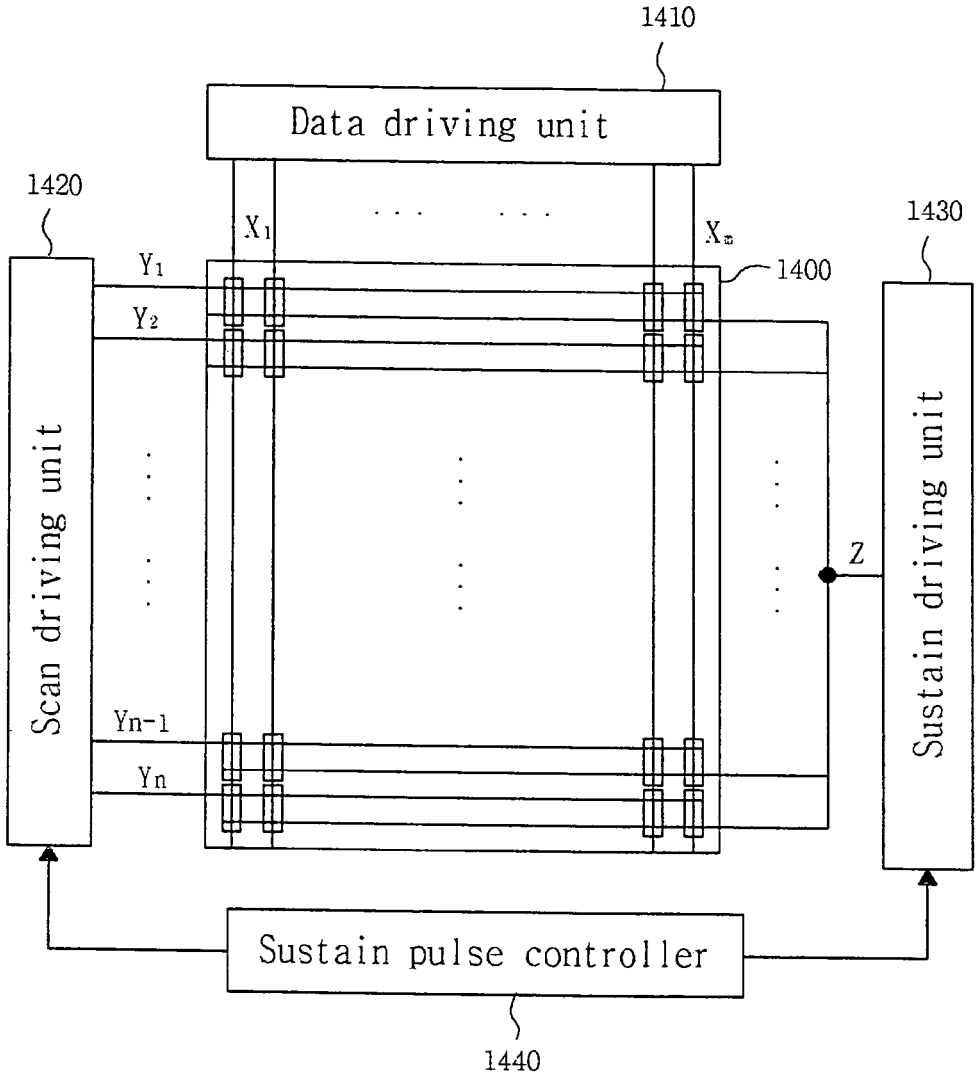
FIG. 14 shows the construction of a plasma display apparatus according to a second embodiment of the present invention.

FIG. 14 shows the construction of a plasma display apparatus according to a second embodiment of the present invention.

Referring to FIG. 14, the plasma display apparatus according to a first embodiment of the present invention includes a plasma display panel 1400, a data driving unit 1410, a scan driving unit 1420, a sustain driving unit 1430 and a sustain waveform controller 1440.

In this case, the constituent elements of the plasma display apparatus according to a second embodiment of the present invention are the same as those of the plasma display apparatus according to the first embodiment of the present invention shown in FIG. 8, but have a different operational characteristic from those of the plasma display apparatus according to a first embodiment of the present invention. More particularly, the sustain waveform controller 1440 having a significantly different operational characteristic from that of the first embodiment of the present invention has the following operational characteristic.

The sustain waveform controller 1440 controls the operation of each of the scan driving unit 1420 and the sustain driving unit 1430 in the sustain period. More particularly, the sustain waveform controller 1440 according to a first embodiment of the present invention controls the scan driving unit 1420 and the sustain driving unit 1430 to control at least one of a rising time and a falling time of a sustain waveform, which is supplied to at least one of the scan electrodes $Y_1$ to Yn and the sustain electrode Z according to a temperature of the plasma display panel 1400.

More particularly, the sustain waveform controller 1440 according to the second embodiment of the present invention controls a time corresponding to a time point at which a sustain discharge is generated, of a rising time and a falling time. At this time, the time point at which a sustain discharge is generated can be controlled by overlapping sustain waveforms supplied to the scan electrodes $Y_1$ to Yn and the sustain electrode Z. It is thus possible to prevent erroneous discharge more effectively by taking a time point of sustain discharge at which sustain light is usually generated into consideration.

The operation of the plasma display apparatus constructed above according to the second embodiment of the present invention will be described in more detail with reference to FIGS. 15*a* to 18*b*.

Figure 15A:
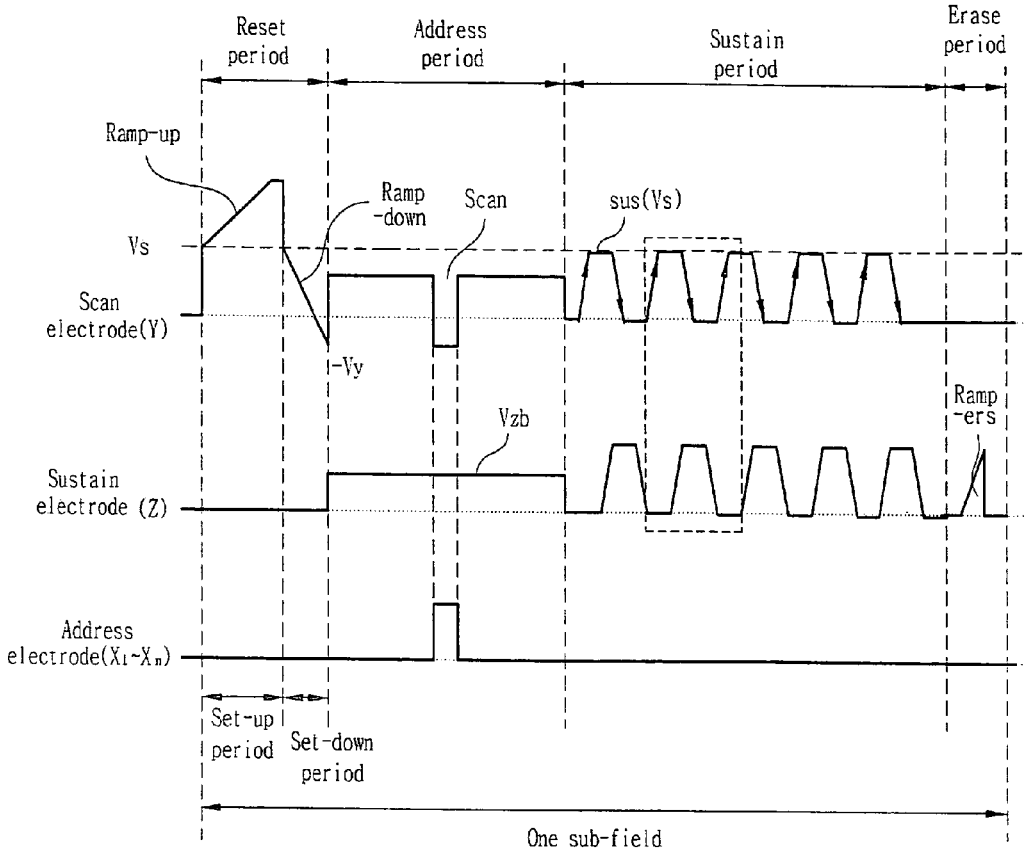
FIGS. 15*a* and 15*b* are views for illustrating a driving waveform of the plasma display apparatus according to a second embodiment of the present invention.
Figure 15B:
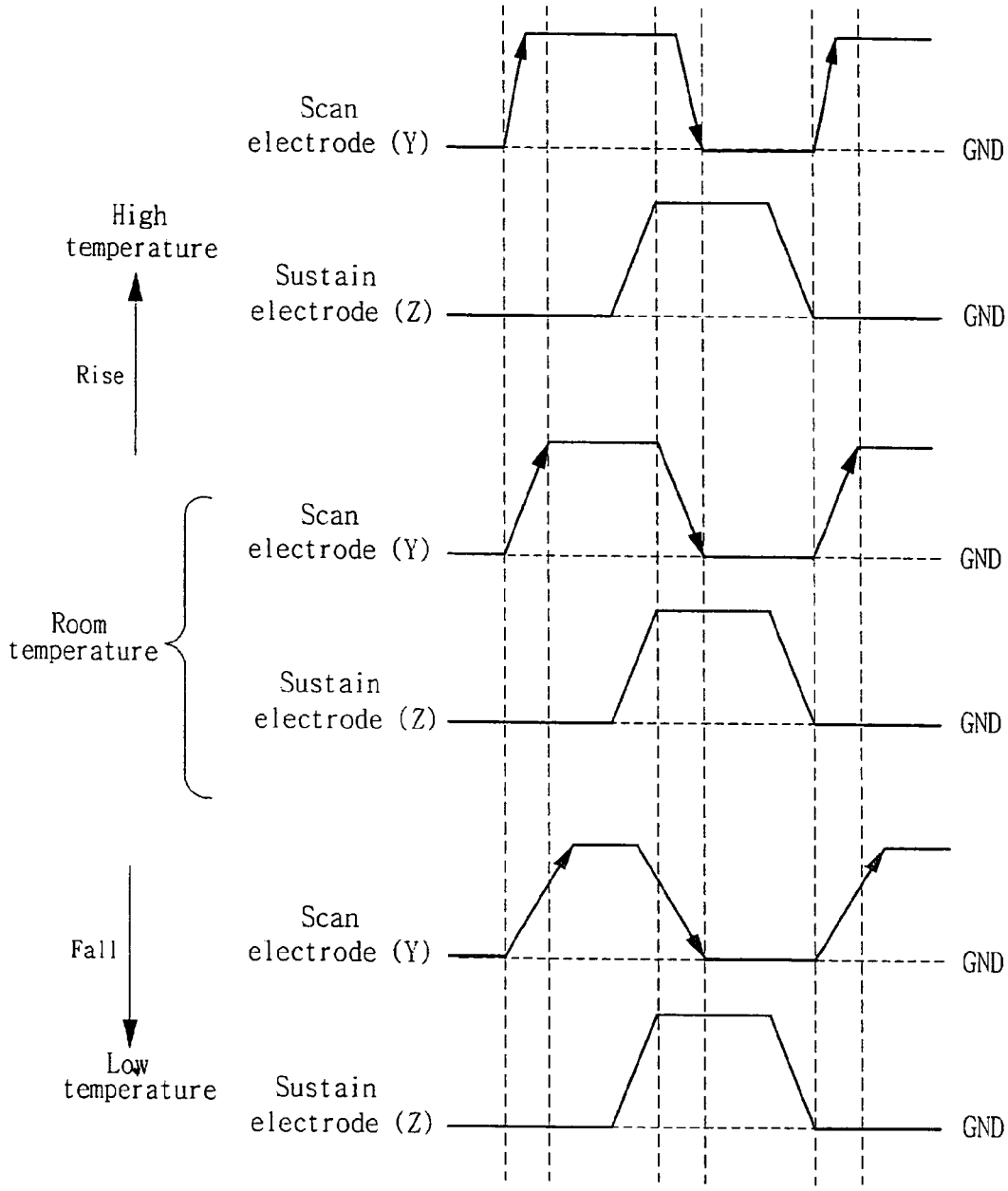

FIGS. 15*a* and 15*b* are views for illustrating a driving waveform of the plasma display apparatus according to a second embodiment of the present invention. FIG. 15*a* shows a waveform applied during one sub-field in the plasma display apparatus according to the second embodiment of the present invention. FIG. 15*b* shows a negative sustain waveform supplied in the sustain period of FIG. 15*a*.

As shown in FIG. 15*a*, another driving waveform of the plasma display apparatus according to the second embodiment of the present invention is driven with it being divided into a reset period for initializing the entire cells, an address period for selecting a cell to be discharged, a sustain period for sustaining discharging of the selected cell, and an erase period for erasing wall charges within the cell to be discharged.

In this case, description on waveforms applied in the reset period, the address period and the erase period of FIG. 15*a* is the same as that on the waveforms applied in the reset period, the address period and the erase period of FIG. 9*a*. Description thereof will be omitted.

In the sustain period, a sustain waveform (Sus) is applied to one or more of the scan electrodes Y and the sustain electrode Z. In a cell selected by address discharge in the sustain period, a sustain discharge, i.e., a display discharge is generated between the scan electrodes Y and the sustain electrode Z whenever every sustain waveform is applied as a wall voltage within the cell and the sustain waveform are added. At this time, in the second embodiment of the present invention, the sustain waveforms applied to the scan electrodes Y and the sustain electrode Z are overlapped, as shown in the drawings. In this case, a phase of the sustain waveform applied to the scan electrodes Y is prior to that of the sustain electrode Z. Accordingly, a sustain discharge is generated in a rising period and a falling period of the sustain waveforms supplied to the scan electrodes. An arrow (◢) in FIG. 15*a* indicates a time point at which the sustain discharge is generated.

As described above, if the sustain waveform supplied to the scan electrodes Y and the sustain waveform supplied to the sustain electrode Z are overlapped, the number of sustain waveforms included in a predetermined sustain period can be kept constant although the rising time or the falling time of the sustain waveform is changed excessively. It is also possible to arbitrarily control a sustain discharge time point, if needed.

Accordingly, in the second embodiment of the present invention, at least one of the rising time or the falling time of the sustain waveform supplied to at least one of the scan electrodes Y and the sustain electrode Z during the sustain period is controlled according to a temperature of the plasma display panel, wherein a time corresponding to a time point at which a sustain discharge is generated is controlled. Thereby, sustain light can be controlled in a more reliable manner depending on a temperature of the plasma display panel.

As shown in FIG. 15*b*, a rising time and a falling time of sustain waveforms supplied to the scan electrodes Y is controlled according to a temperature of the plasma display panel. When a temperature of the plasma display panel is higher than room temperature, the rising time (ER-Up-Time) and the falling time (ER-Down-time) of the sustain waveforms supplied to the scan electrodes Y, which correspond to a time point at which a sustain discharge is generated, is controlled to be shorter than those at room temperature. When a temperature of the plasma display panel is lower than room temperature, the rising time (ER-Up-Time) and the falling time (ER-Down-time) of the sustain waveforms supplied to the scan electrodes Y, which correspond to a time point at which a sustain discharge is generated, is controlled to be longer than those at room temperature.

Figure 16:
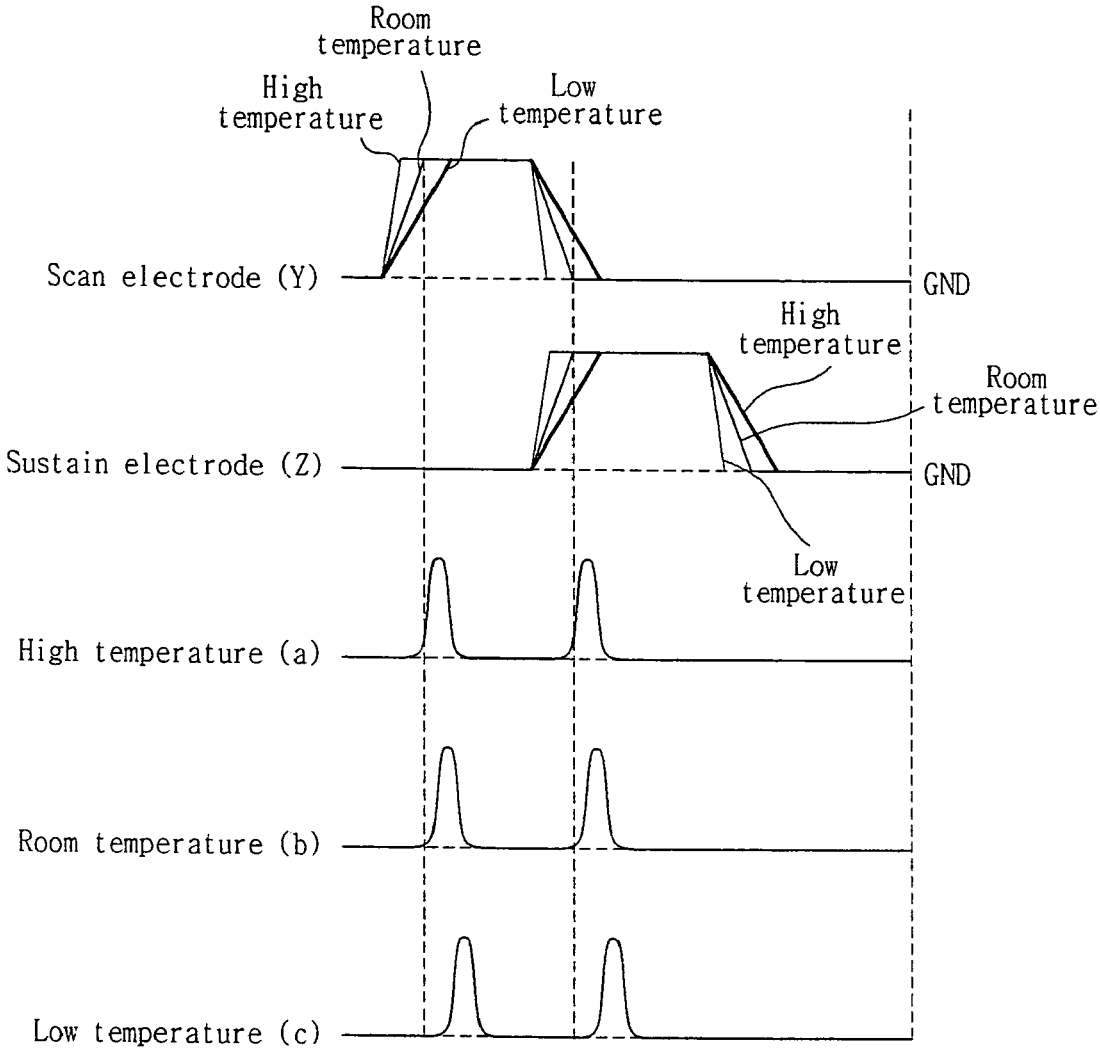
FIG. 16 is a view for illustrating a sustain light characteristic of the sustain waveform of the plasma display apparatus according to a second embodiment of the present invention.

FIG. 16 is a view for illustrating a sustain light characteristic of the sustain waveform of the plasma display apparatus according to a second embodiment of the present invention.

As shown in FIG. 16, regarding a sustain light characteristic depending on a temperature in the second embodiment of the present invention, the amount of sustain light generated by sustain waveforms when a temperature of the plasma display panel is high and low is the same as that when a temperature of the plasma display panel is room temperature, compared with the conventional sustain light characteristic. In this case, the reason why the amount of sustain light is the same at high temperature, room temperature and low temperature has been sufficiently described with reference to FIG. 10. Description thereof will be omitted.

Meanwhile, Referring to FIG. 16, the rising time and the falling time of the sustain waveforms supplied to the scan electrodes Y and the sustain electrode Z is controlled according to a temperature of the plasma display panel. This is another sustain waveform according to the second embodiment of the present invention, wherein a rising time and a falling time of sustain waveforms supplied to not only the scan electrodes Y, but the sustain electrode Z are controlled when a sustain discharge is generated in the rising time and the falling time of the sustain waveforms supplied to the scan electrodes Y in FIGS. 15*a* and 15*b*.

For example, in the case where a sustain discharge is generated in a falling time of a sustain waveform supplied to the scan electrodes Y, the falling time of the sustain waveform supplied to the scan electrodes Y and the rising time of the sustain waveform supplied to the sustain electrode Z, which correspond to time points at which a sustain discharge is generated, are controlled at the same time.

Thereby, sustain light can be controlled in an effective way according to a temperature of the plasma display panel.

Figure 17A:
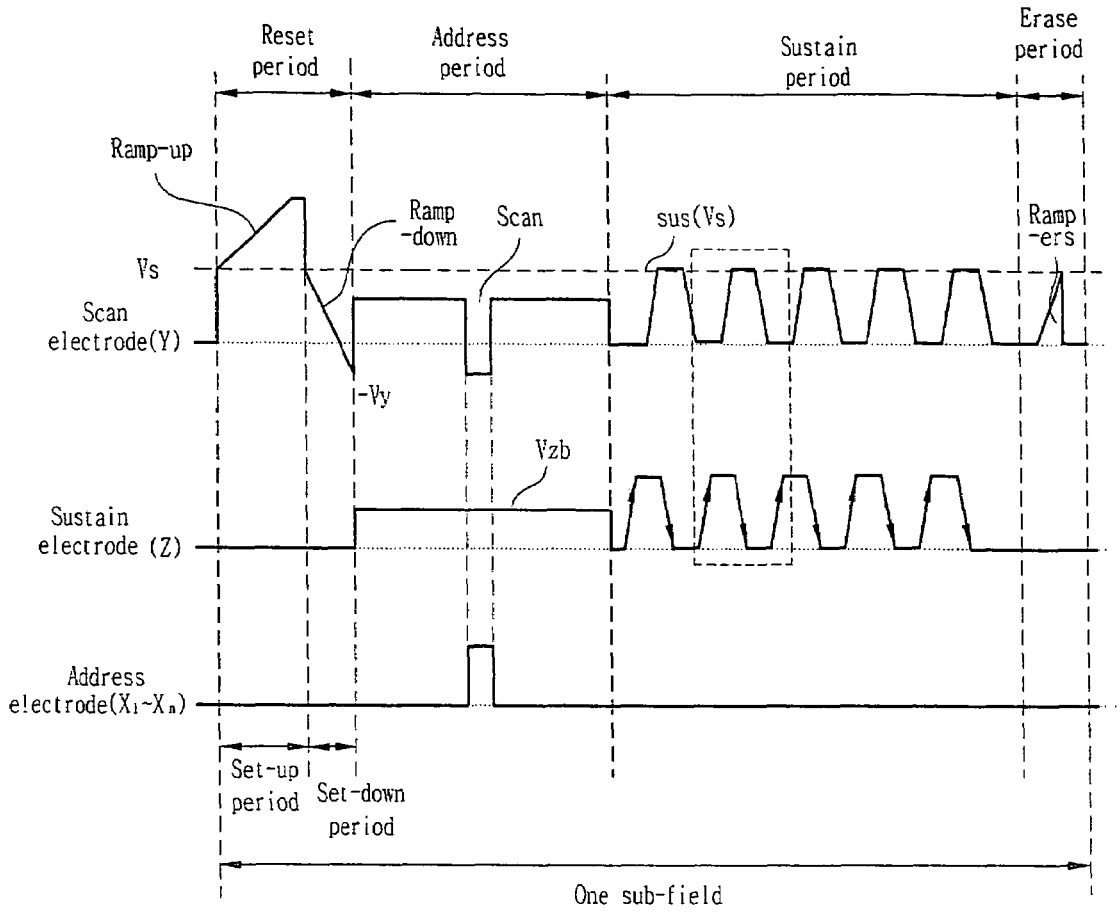
FIGS. 17*a* and 17*b* are views for illustrating another driving waveform of the plasma display apparatus according to a second embodiment of the present invention.
Figure 17B:
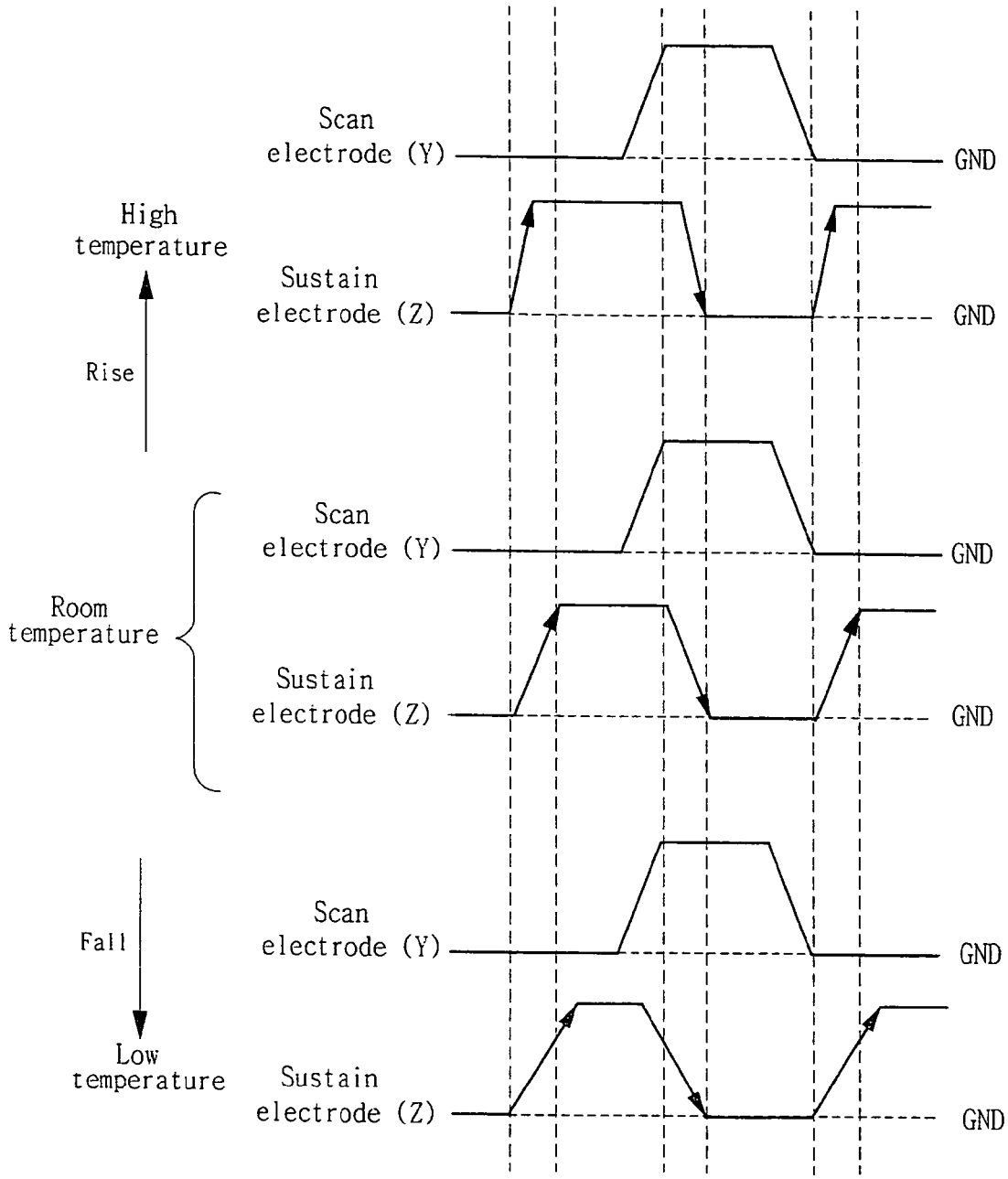

FIGS. 17*a* and 17*b* are views for illustrating another driving waveform of the plasma display apparatus according to a second embodiment of the present invention. FIG. 17*a* shows another driving waveform applied during one sub-field in the plasma display apparatus according to the second embodiment of the present invention. FIG. 17*b* shows a sustain waveform supplied in the sustain period of FIG. 17*a*.

As shown in FIG. 17*a*, another driving waveform of the plasma display apparatus according to the second embodiment of the present invention is driven with it being divided into a reset period for initializing the entire cells, an address period for selecting a cell to be discharged, a sustain period for sustaining discharging of the selected cell, and an erase period for erasing wall charges within the cell to be discharged.

In this case, description on waveforms applied in the reset period, the address period and the erase period of FIG. 17*a* is the same as that on the waveforms applied in the reset period, the address period and the erase period of FIG. 9*a*. Description thereof will be omitted.

In the sustain period, a sustain waveform (Sus) is applied to one or more of the scan electrodes Y and the sustain electrode Z. In a cell selected by address discharge in the sustain period, a sustain discharge, i.e., a display discharge is generated between the scan electrodes Y and the sustain electrode Z whenever every sustain waveform is applied as a wall voltage within the cell and the sustain waveform are added. At this time, in the second embodiment of the present invention, the sustain waveforms applied to the scan electrodes Y and the sustain electrode Z are overlapped, as shown in the drawings. In this case, a phase of the sustain waveform applied to the sustain electrode Z is prior to that of the scan electrodes Y. Accordingly, a sustain discharge is generated in a rising period and a falling period of the sustain waveforms supplied to the sustain electrode Z. An arrow (◢) in FIG. 17*a* indicates a time point at which the sustain discharge is generated.

Accordingly, in the second embodiment of the present invention, at least one of the rising time or the falling time of the sustain waveform supplied to at least one of the scan electrodes Y and the sustain electrode Z during the sustain period is controlled according to a temperature of the plasma display panel, wherein a time corresponding to a time point at which a sustain discharge is generated is controlled. Thereby, sustain light can be controlled in a more reliable manner depending on a temperature of the plasma display panel.

As shown in FIG. 17*b*, a rising time and a falling time of a sustain waveform supplied to the sustain electrode Z is controlled according to a temperature of the plasma display panel. When a temperature of the plasma display panel is higher than room temperature, the rising time (ER-Up-Time) and the falling time (ER-Down-time) of the sustain waveform supplied to the sustain electrode Z, which correspond to a time point at which a sustain discharge is generated, is controlled to be shorter than those at room temperature. When a temperature of the plasma display panel is lower than room temperature, the rising time (ER-Up-Time) and the falling time (ER-Down-time) of the sustain waveform supplied to the sustain electrode Z, which correspond to a time point at which a sustain discharge is generated, is controlled to be longer than those at room temperature. Further, as described with reference to FIG. 16, both sustain waveforms applied to the scan electrodes Y and the sustain electrode Z at a time point at which a sustain discharge is generated can be controlled.

Figure 18A:
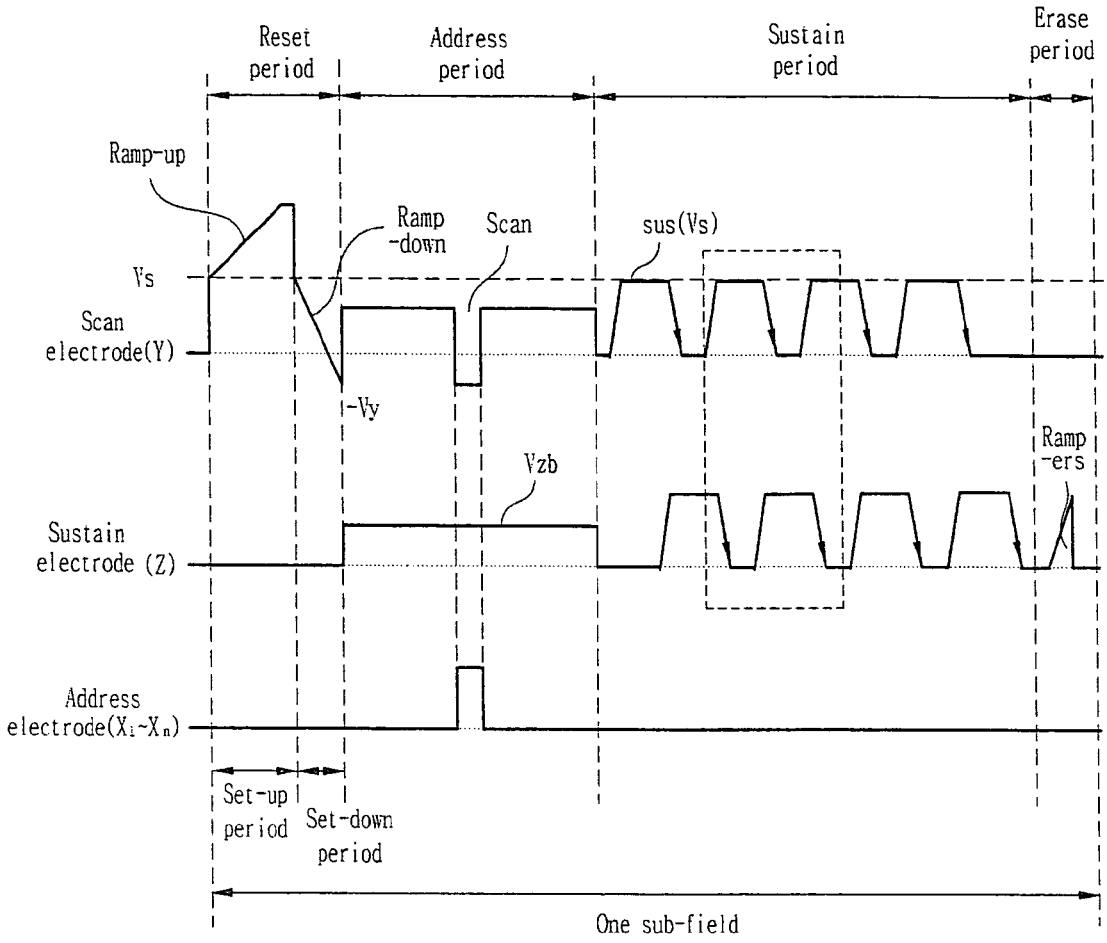
FIGS. 18*a* and 18*b* are views for illustrating further another driving waveform of the plasma display apparatus according to a second embodiment of the present invention.
Figure 18B:
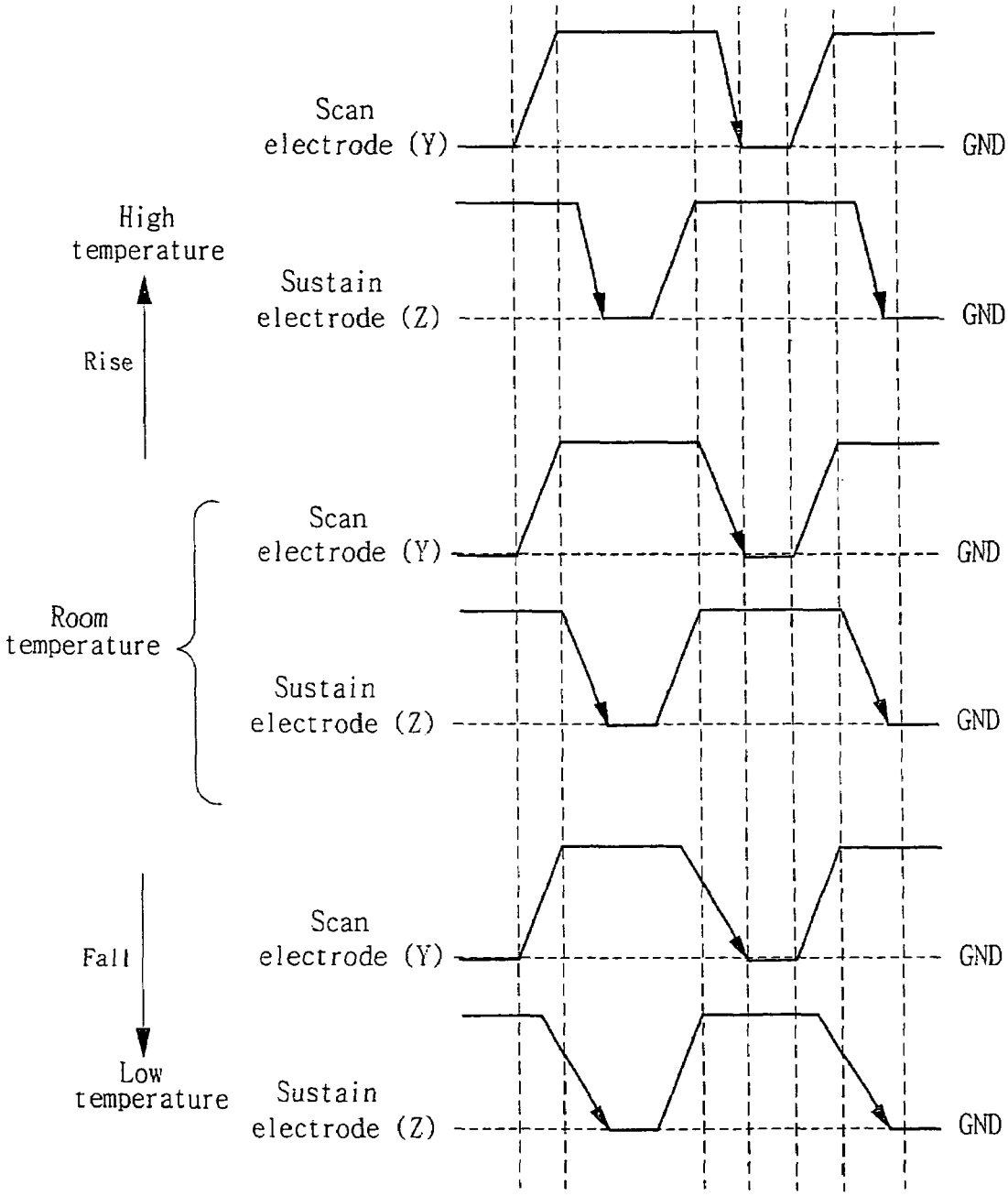

FIGS. 18*a* and 18*b* are views for illustrating further another driving waveform of the plasma display apparatus according to a second embodiment of the present invention. FIG. 18*a* shows another driving waveform applied during one sub-field in the plasma display apparatus according to the second embodiment of the present invention. FIG. 18*b* shows a sustain waveform supplied in the sustain period of FIG. 18*a*.

As shown in FIG. 18*a*, another driving waveform of the plasma display apparatus according to the second embodiment of the present invention is driven with it being divided into a reset period for initializing the entire cells, an address period for selecting a cell to be discharged, a sustain period for sustaining discharging of the selected cell, and an erase period for erasing wall charges within the cell to be discharged.

In this case, description on waveforms applied in the reset period, the address period and the erase period of FIG. 18*a* is the same as that on the waveforms applied in the reset period, the address period and the erase period of FIG. 9*a*. Description thereof will be omitted.

In the sustain period, a sustain waveform (Sus) is applied to at least one of the scan electrodes Y and the sustain electrode Z. In a cell selected by address discharge in the sustain period, a sustain discharge, i.e., a display discharge is generated between the scan electrodes Y and the sustain electrode Z whenever every sustain waveform is applied as a wall voltage within the cell and the sustain waveform are added. At this time, in the second embodiment of the present invention, the sustain waveforms applied to the scan electrodes Y and the sustain electrode Z are overlapped, as shown in the drawings. In this case, the width of a sustain waveform supplied to any one of the scan electrodes Y and the sustain electrode Z as the sustain voltage (Vs) level is set to be wider than that of a sustain reference waveform kept in an opposite electrode as the ground level (GND) in synchronization with the sustain waveform. Accordingly, a sustain discharge is generated in a falling period of sustain waveforms respectively supplied to the scan electrodes Y and the sustain electrode Z. An arrow (◢) in FIG. 18*a* indicates a time point at which the sustain discharge is generated.

As shown in FIG. 18*b*, a falling time of sustain waveforms respectively supplied to the scan electrodes Y and the sustain electrode Z is controlled according to a temperature of the plasma display panel. When a temperature of the plasma display panel is higher than room temperature, a falling time of sustain waveforms respectively supplied to the scan electrodes Y and the sustain electrode Z, which corresponds to a time point at which a sustain discharge is generated, is controlled to be shorter than that at room temperature. When a temperature of the plasma display panel is lower than room temperature, a falling time of sustain waveforms respectively supplied to the scan electrodes Y and the sustain electrode Z, which corresponds to a time point at which a sustain discharge is generated, is controlled to be longer than that at room temperature.

Meanwhile, even in the second embodiment of the present invention, in the same manner as the first embodiment of the present invention, a critical temperature is previously set. Furthermore, a first critical temperature is set to 60° C. A rising or falling time when a temperature exceeds the first critical temperature is controlled to be below 75% to 95% of a rising or falling time when the temperature is lower than the first critical temperature. Furthermore, a second critical temperature is set to 20° C. A rising or falling time when a temperature is les than the second critical temperature is controlled to be below 105% to 125% of a rising or falling time when the temperature is higher than the second critical temperature. It is thus possible to improve the picture quality of the plasma display apparatus in a more effective manner.

In addition, the sustain waveform controller according to the second embodiment of the present invention can increase a falling time of sustain waveforms respectively applied to sustain electrode pairs when a temperature is the second critical temperature. Accordingly, a self-erase discharge can be prohibited.

As described above, the present invention improves a plasma display apparatus and driving method thereof. Accordingly, there is an effect in that erroneous discharge depending on a temperature of a plasma display panel can be prevented.

Furthermore, the present invention improves a plasma display apparatus and driving method thereof. Accordingly, there is an effect in that a reduction in brightness when a temperature rises can be prohibited.

Furthermore, the present invention improves a plasma display apparatus and driving method thereof. Accordingly, there is an effect in that generation of defective hot spots can be prevented.

Furthermore, the present invention improves a plasma display apparatus and driving method thereof. Accordingly, there is an effect in that a self-erase discharge can be prohibited.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A plasma display apparatus, comprising:

a plasma display panel having a plurality of sustain electrode pairs, wherein each of the sustain electrode pairs has a scan electrode and a sustain electrode; and a sustain waveform controller for controlling a rising time or a falling time of sustain waveforms supplied to at least one of the sustain electrode pairs according to a temperature of the plasma display panel, wherein the rising time is a time interval during which a voltage of a sustain waveform rises from a minimum level to a maximum level thereof.

2. The plasma display apparatus as claimed in claim 1, wherein the sustain waveform controller controls a time point at which a sustain discharge is generated, during the rising time or the falling time of the sustain waveforms.

3. The plasma display apparatus as claimed in claim 2, wherein the sustain waveform controller controls the time point at which the sustain discharge is generated by overlapping the sustain waveforms.

4. The plasma display apparatus as claimed in claim 1, wherein when the temperature increases, the rising time or the falling time is reduced.

5. The plasma display apparatus as claimed in claim 1, wherein when the temperature decreases, the rising time or the falling time is increased.

6. The plasma display apparatus as claimed in claim 1, wherein the sustain waveform controller determines variations in the temperature by comparing at least one or more critical temperatures that are previously set with the temperature.

7. The plasma display apparatus as claimed in claim 6, wherein a predetermined first critical temperature is set, and the rising time or the falling time when the temperature exceeds the first critical temperature is set to be 75% to 95% of the rising time or the falling time when the temperature is lower than the first critical temperature.

8. The plasma display apparatus as claimed in claim 7, wherein the first critical temperature is 60° C.

9. The plasma display apparatus as claimed in claim 6, wherein a predetermined second critical temperature is set, and the rising time or the falling time when the temperature is less than the second critical temperature is set to be 105% to 125% of the rising time or the falling time when the temperature is higher than the second critical temperature.

10. The plasma display apparatus as claimed in claim 9, wherein the second critical temperature is 20° C.

11. The plasma display apparatus as claimed in claim 9, wherein the sustain waveform controller increases a falling time of sustain waveforms supplied to the sustain electrode pairs when the temperature is lower than the second critical temperature.

12. A plasma display apparatus, comprising:

a plasma display panel having a plurality of sustain electrode pairs, wherein each of the sustain electrode pairs has a scan electrode and a sustain electrode; and a sustain waveform controller for controlling a time point at which a sustain discharge is generated, during a rising time or a falling time of sustain waveforms supplied to at least one of the sustain electrode pairs, according to a temperature of the plasma display panel, wherein the rising time is a time interval during which a voltage of a sustain waveform rises from a minimum level to a maximum level thereof.

13. A method of driving a plasma display apparatus, wherein images are implemented on a plasma display panel by applying sustain waveforms to a plurality of sustain electrode pairs and wherein each of the sustain electrode pairs has a scan electrode and a sustain electrode, the method comprising:

(a) detecting a temperature of the plasma display panel; and (b) controlling a rising time or a falling time of a sustain waveform applied to at least one of the sustain electrode pairs according to the temperature, wherein the rising time is a time interval during which a voltage of a sustain waveform rises from a minimum level to a maximum level thereof.

14. The method as claimed in claim 13, wherein during controlling the rising time or the falling time, a time point at which a sustain discharge is generated, during the rising time or the falling time, is controlled.

15. The method as claimed in claim 14, wherein during controlling the rising time or the falling time, the time point at which the sustain discharge is generated is controlled by overlapping the sustain waveforms.

16. The method as claimed in claim 13, wherein when the temperature increases, the rising time or the falling time is reduced.

17. The method as claimed in claim 13, wherein when the temperature decreases, the rising time or the falling time is increased.

18. The method as claimed in claim 13, wherein during controlling the rising time or the falling time, at least one critical temperature is set, and variations in the temperature is determined by comparing the temperature with the critical temperature.

19. The method as claimed in claim 18, wherein during controlling the rising time or the falling time, a predetermined first critical temperature is set, and the rising time or the falling time when the temperature exceeds the first critical temperature is set to be 75% to 95% of the rising time or the falling time when the temperature is lower than the first critical temperature.

20. The method as claimed in claim 19, wherein the first critical temperature is 60° C.

21. The method as claimed in claim 18, wherein during controlling the rising time or the falling time, a predetermined second critical temperature is set, and the rising time or the falling time when the temperature is less than the second critical temperature is set to be 105% to 125% of the rising time and the falling time when the temperature is higher than the second critical temperature.

22. The method as claimed in claim 21, wherein the second critical temperature is 20° C.

23. The method as claimed in claim 21, wherein when the temperature is lower than the second critical temperature, a falling time of sustain waveforms respectively supplied to the sustain electrode pairs is increased.

* * * * *